US008316664B2

(12) United States Patent
Hasegawa et al.

(10) Patent No.: US 8,316,664 B2
(45) **Date of Patent: *Nov. 27, 2012**

(54) REFRIGERATION CYCLE APPARATUS AND FLUID MACHINE USED THEREFOR

(75) Inventors: Hiroshi Hasegawa, Osaka (JP); Masaru Matsui, Kyoto (JP); Takeshi Ogata, Osaka (JP); Shingo Oyagi, Osaka (JP); Masanobu Wada, Osaka (JP)

(73) Assignee: Panasonic Corporation, Osaka (JP)

( * ) Notice: Subject to any disclaimer, the term of this patent is extended or adjusted under 35 U.S.C. 154(b) by 912 days.

This patent is subject to a terminal disclaimer.

(21) Appl. No.: 12/443,584

(22) PCT Filed: Feb. 25, 2008

(86) PCT No.: PCT/JP2008/000329

§ 371 (c)(1),
(2), (4) Date: Mar. 30, 2009

(87) PCT Pub. No.: WO2008/139667

PCT Pub. Date: Nov. 20, 2008

(65) Prior Publication Data

US 2010/0089092 A1 Apr. 15, 2010

(30) Foreign Application Priority Data

May 16, 2007 (JP) ..... 2007-130099

(51) Int. Cl.
*F25B 1/00* (2006.01)
*F04B 17/00* (2006.01)

(52) U.S. Cl. ..... 62/510; 62/324.6; 417/205; 417/206

(58) Field of Classification Search ..... 417/199.1, 417/205, 206; 62/87, 116, 324.6, 500, 510
See application file for complete search history.

(56) References Cited

U.S. PATENT DOCUMENTS

| | | | | |
|---|---|---|---|---|
| 2007/0053782 | A1* | 3/2007 | Okamoto et al. | 418/30 |
| 2007/0151266 | A1* | 7/2007 | Yakumaru et al. | 62/197 |
| 2008/0310983 | A1* | 12/2008 | Sakitani et al. | 418/55.1 |
| 2010/0132398 | A1* | 6/2010 | Takahashi et al. | 62/468 |
| 2010/0180628 | A1* | 7/2010 | Hasegawa et al. | 62/468 |

FOREIGN PATENT DOCUMENTS

EP 1 873 350 1/2008

(Continued)

OTHER PUBLICATIONS

Kohsokabe et al., "Basic Operating Characteristic of $CO_2$ Refrigeration Cycles with Expander-Compressor Unit". International Refrigeration and Air Conditioning Conference at Purdue, R159, Jul. 17-20, 2006.

*Primary Examiner* — Devon Kramer
*Assistant Examiner* — Dominick L Plakkoottam
(74) *Attorney, Agent, or Firm* — Hamre, Schumann, Mueller & Larson, P.C.

(57) ABSTRACT

A fluid machine (10) includes a closed casing (11) in which an oil reservoir (16) for holding oil is formed in a bottom part. Disposed in the closed casing (11) are: a main compression mechanism (3), for compressing a working fluid, to which the oil held the oil reservoir (16) is supplied; a rotary electric motor (8) disposed above the oil reservoir (16) in the closed casing (11); a main compressor shaft (38) for coupling the main compression mechanism (3) and the rotary electric motor (8) to each other; a power recovery mechanism (5) for recovering motive power from the working fluid by performing a suction process for drawing the working fluid and a discharge process for discharging the drawn working fluid; a sub compression mechanism (2), which is driven by the power recovery mechanism (5), for compressing the working fluid and discharging the working fluid to the main compression mechanism (3) side; and a power recovery shaft (12) for coupling the power recovery mechanism (5) and the sub compression mechanism (2) to each other.

14 Claims, 9 Drawing Sheets

FOREIGN PATENT DOCUMENTS

| | | |
|---|---|---|
| JP | 2004-325018 | 11/2004 |
| JP | 2004-325019 | 11/2004 |
| JP | 2005-98604 | 4/2005 |
| JP | 2006-266171 | 10/2006 |
| JP | 2007-315227 | 12/2007 |
| WO | WO 2006/103821 | 10/2006 |

* cited by examiner

REFRIGERATION CYCLE APPARATUS AND FLUID MACHINE USED THEREFOR

TECHNICAL FIELD

The present invention relates to a refrigeration cycle apparatus and a fluid machine used therefor.

BACKGROUND ART

Generally, a refrigerant circuit is constructed of a compressor for compressing a refrigerant, a radiator for cooling the refrigerant, an expansion valve for expanding the refrigerant, and an evaporator for heating the refrigerant, which are connected serially. In the refrigeration cycle of this refrigerant circuit, the refrigerant undergoes a pressure drop at the expansion valve from a high pressure to a low pressure while expanding, at which time the internal energy is released. Accordingly, when the pressure difference is large between the low pressure side (the evaporator side) and the high pressure side (the radiator side) in the refrigerant circuit, the released internal energy becomes relatively great. As a consequence, the energy efficiency of the refrigeration cycle degrades considerably.

In view of such a problem, various techniques have been proposed for recovering the internal energy of the refrigerant that is released at the time of the expansion. For example, JP 2006-266171 A and Document 1 (International Refrigeration and Air Conditioning Conference at Purdue, Jul. 17-20, 2006, R169, "BASIC OPERATING CHARACTERISTICS OF $CO_2$ REFRIGERATION CYCLES WITH EXPANDER-COMPRESSOR UNIT") propose refrigeration cycle apparatuses that perform power recovery using, as a power recovery mechanism, a positive displacement-type fluid machine in which an expansion mechanism and a blower (sub compression mechanism) are coupled to each other by a shaft.

In the refrigeration cycle apparatus as disclosed in JP 2006-266171 A and Document 1, the positive displacement-type fluid machine and a main compression mechanism are accommodated in separate closed casings respectively, as shown in FIG. 6 of JP 2006-266171 A. An oil reservoir for holding refrigeration oil that is supplied for the positive displacement-type fluid machine and the main compression mechanism is provided in each of the closed casings.

However, the amount of the refrigeration oil discharged from the main compression mechanism to the refrigerant circuit is not always equal to the amount of the refrigeration oil discharged from the positive displacement-type fluid machine to the refrigerant circuit. Normally, one of the amount of the refrigeration oil discharged from the main compression mechanism to the refrigerant circuit and the amount of the refrigeration oil discharged from the positive displacement-type fluid machine to the refrigerant circuit is greater than the other. Consequently, the amount of the refrigeration oil held in one of the oil reservoirs and that held in the other oil reservoir may be off-balanced when separate oil reservoirs are provided respectively for the closed casing accommodating the positive displacement-type fluid machine and the closed casing accommodating the main compression mechanism as in the refrigeration cycle apparatus disclosed in JP 2006-266171 A and Document 1. In other words, one of the closed casings may contain an excessive amount of refrigeration oil while the other closed casing may contain too little refrigeration oil. In that case, lubrication and sealing of the positive displacement-type fluid machine and the main compression mechanism may not be performed appropriately.

For example, Document 1 discloses that an oil separator is disposed between the main compression mechanism and a radiator so that the refrigeration oil recovered by the oil separator is supplied to the closed casing that accommodates an expansion mechanism-sub compression mechanism unit. This inhibits, for example, a decrease in the amount of the refrigeration oil held in the closed casing that accommodates the expansion mechanism-sub compression mechanism unit.

Nevertheless, even when the oil separator is provided between the main compression mechanism and the radiator as described in Document 1, it is still difficult to suppress a decrease in the amount of the refrigeration oil held in the oil reservoir within the closed casing that accommodates the expansion mechanism-sub compression mechanism unit or in the oil reservoir within the closed casing that accommodates the main compression mechanism sufficiently. The reason is that, even when the refrigeration oil recovered by the oil separator is supplied to the closed casing that accommodates the expansion mechanism-sub compression mechanism unit, the amount of the refrigeration oil held in the oil reservoir within the closed casing that accommodates the expansion mechanism-sub compression mechanism unit decreases when the amount of the refrigeration oil discharged from the expansion mechanism-sub compression mechanism unit to the refrigerant circuit exceeds the amount of the refrigeration oil recovered by the oil separator. Also, the amount of the refrigeration oil held in the oil reservoir within the closed casing that accommodates the main compression mechanism decreases when the amount of the refrigeration oil discharged from the main compression mechanism to the refrigerant circuit is relatively large.

DISCLOSURE OF THE INVENTION

The present invention has been accomplished in view of such circumstances, and it is an object to achieve a stable supply of oil to the compression mechanism and the power recovery mechanism.

A fluid machine according to the present invention includes: a closed casing in which an oil reservoir is formed in a bottom part; a main compression mechanism, disposed in the closed casing for compressing a working fluid, and to which oil held in the oil reservoir is supplied; a rotary electric motor disposed above the oil reservoir in the closed casing; a main compressor shaft for coupling the main compression mechanism and the rotary electric motor to each other so that the main compression mechanism is driven by the rotary electric motor; a power recovery mechanism, disposed in the oil reservoir, for recovering motive power from the working fluid by performing a suction process for drawing the working fluid and a discharge process for discharging the drawn working fluid; a sub compression mechanism, disposed in the oil reservoir and driven by the power recovery mechanism, for compressing the working fluid and discharging the working fluid to the main compression mechanism side; and a power recovery shaft for coupling the power recovery mechanism and the sub compression mechanism to each other so that the sub compression mechanism is driven by motive power recovered by the power recovery mechanism.

In fluid machine according to the present invention, the oil for lubricating main compression mechanism, the sub compression mechanism, and the power recovery mechanism is held collectively in the oil reservoir within the closed casing. Therefore, the problem of an excess or shortage of the refrigeration oil substantially does not arise. As a result, the oil can be supplied stably to the main compression mechanism and the power recovery unit.

A refrigeration cycle apparatus according to the present invention includes a fluid machine according to the present invention.

According to the present invention, oil can be supplied stably to the compression mechanism and the power recovery mechanism.

BEST MODE FOR CARRYING OUT THE INVENTION

Embodiment

Figure 1:
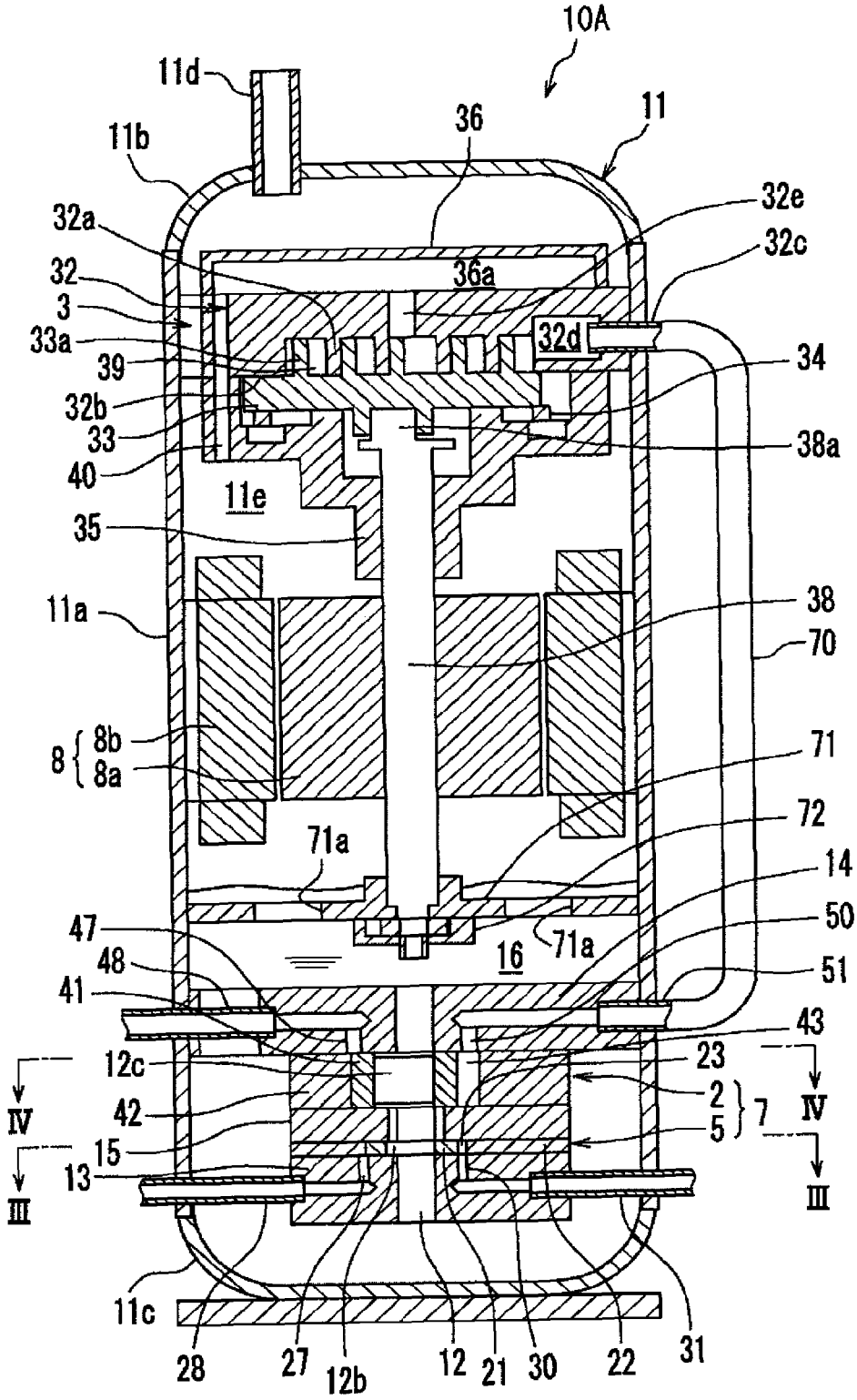
FIG. 1 is a cross-sectional view illustrating a fluid machine according to one embodiment.
Figure 2:
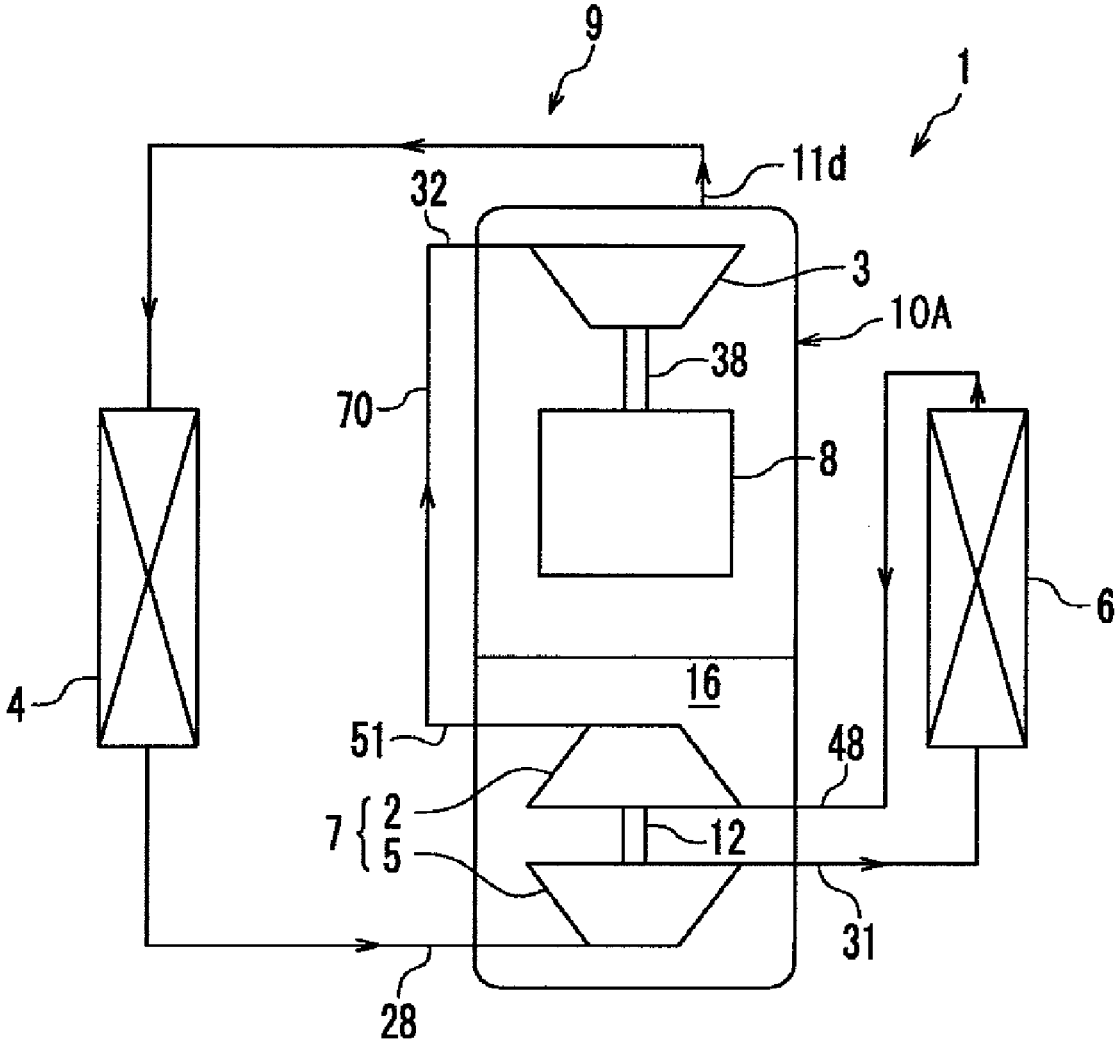
FIG. 2 is a configuration diagram of the refrigeration cycle apparatus according to the embodiment.

FIG. 1 is a cross-sectional view of a fluid machine 10A used for a refrigeration cycle apparatus 1 according to the present embodiment. FIG. 2 is a configuration diagram of the refrigeration cycle apparatus 1 according to the embodiment. First, a schematic configuration of the refrigeration cycle apparatus 1 will be described with reference to FIG. 2. It should be noted that the refrigeration cycle apparatus 1 described herein is merely one example of preferred embodiments of the present invention, and the present invention is not limited to the configurations shown below.

<Schematic Configuration of the Refrigeration Cycle Apparatus 1>

As illustrated in FIG. 2, the refrigeration cycle apparatus includes a refrigerant circuit 9 having a main compression mechanism 3, a radiator 4, a power recovery mechanism 5, an evaporator 6, and a sub compression mechanism 2. The refrigerant circuit 9 is charged with a refrigerant that reaches a supercritical pressure on the high pressure side, which is from the main compression mechanism 3 through the radiator 4 to the power recovery mechanism 5. Specifically, the refrigerant circuit 9 is charged with carbon dioxide. It should be noted, however, that the invention is not limited to this configuration. For example, the refrigerant circuit 9 may be charged with a refrigerant that does not reach a supercritical pressure on the high pressure side. Specifically, the refrigerant circuit 9 may be charged with a fluorocarbon-based refrigerant.

The main compression mechanism 3 is driven by a motor 8 (rotary electric motor). The main compression mechanism 3 compresses the refrigerant, which circulates in the refrigerant circuit 9, to high temperature and high pressure. It should be noted that the present embodiment describes an example in which the main compression mechanism 3 is a scroll-type compression mechanism. However, in the present invention, the main compression mechanism 3 it not limited to a scroll-type compression mechanism. In the present invention, the main compression mechanism 3 may be, for example, a rotary-type compression mechanism.

The radiator (gas cooler) 4 is connected to the main compression mechanism 3. The radiator 4 causes the refrigerant compressed by the compressor 3 to radiate heat. In other words, the radiator 4 cools the refrigerant compressed by the main compression mechanism 3. The refrigerant cooled by the radiator 4 becomes low temperature and high pressure.

The power recovery mechanism 5 is connected to the radiator 4. In the present embodiment, the power recovery mechanism 5 is constituted by a rotary-type fluid pressure motor. Specifically, the power recovery mechanism 5 performs a process for drawing the refrigerant from the radiator 4 and a process for discharging the drawn refrigerant in a substantially continuous manner. In other words, the power recovery mechanism 5 draws the refrigerant that is turned to be low temperature and high pressure by the radiator 4 and discharges the refrigerant to the evaporator 6 side substantially without changing its volume. Here, the section from the main compression mechanism 3 to the power recovery mechanism 5 is at a high pressure, while the section from the power recovery mechanism 5 to the main compression mechanism 3 is at a low pressure. Therefore, the refrigerant drawn in the power recovery mechanism 5 expands when it is discharged from the power recovery mechanism 5, turning to a low pressure. It should be noted that in the present invention, the power recovery mechanism 5 is not limited to the rotary-type fluid pressure motor. The power recovery mechanism 5 may be a fluid pressure motor other than the rotary type. The power recovery mechanism 5 may be, for example, an expansion mechanism having a particular volumetric capacity ratio (having a volumetric capacity ratio greater than 1).

The evaporator 6 is connected to the power recovery mechanism 5. The evaporator 6 heats the refrigerant supplied from the power recovery mechanism 5 to evaporate it.

The sub compression mechanism 2 is disposed between the evaporator 6 and the main compression mechanism 3. The sub compression mechanism 2 is coupled to the power recovery mechanism 5 by a power recovery shaft 12. The sub compression mechanism 2 is driven by the motive power recovered by the power recovery mechanism 5. After the refrigerant supplied from the evaporator 6 side is preliminarily pressurized by this sub compression mechanism 2, the refrigerant is supplied to the main compression mechanism 3. In the present embodiment, a power recovery unit 7 is constituted by this sub compression mechanism 2 and the power recovery mechanism 5.

It should be noted that the sub compression mechanism 2 is not limited to a mechanism that compresses the drawn refrigerant in a working chamber and thereafter discharges the refrigerant. The sub compression mechanism 2 may be, for example, a fluid pressure motor (also called a blower) that performs a process for drawing the refrigerant supplied from the evaporator 6 and a process for discharging the drawn refrigerant to the main compression mechanism 3 side in a substantially continuous manner. That is, the sub compression mechanism 2 is not particularly limited as long as it is such a mechanism that can pressurize the refrigerant drawn in the main compression mechanism 3. It should be noted that an example in which the sub compression mechanism 2 is constituted by a fluid pressure motor is described herein.

<Specific Configuration of the Refrigeration Cycle Apparatus 1>

(Fluid Machine 10A)

As illustrated in FIGS. 1 and 2, the fluid machine 10A includes a substantially cylindrical columnar closed casing 11, the main compression mechanism 3, a motor 8, and the power recovery unit 7. The closed casing 11 includes a tubular body shell 11*a*, an upper shell 11*b*, and a bottom shell 11*c*. The upper opening of the body shell 11*a* is closed by the upper shell 11*b* in a lid-like shape. On the other hand, the lower opening of the body shell 11*a* is closed by the bottom shell 11*c* in a bowl-like shape.

An oil reservoir 16 for holding refrigeration oil is formed in a bottom part of the closed casing 11. The main compression mechanism 3 and the motor 8 are disposed at locations in the closed casing 11 that are higher than the oil reservoir 16. More specifically, the main compression mechanism 3 is disposed most distantly from the oil reservoir 16. The motor 8 is disposed at a location lower than the main compression mechanism 3. The power recovery unit 7 is disposed in the oil reservoir 16. The sub compression mechanism 2 in the power recovery unit 7 is disposed closer to the main compression mechanism 3. Specifically, the sub compression mechanism 2 is disposed at a relatively high location.

(Configurations of the Motor 8 and the Main Compression Mechanism 3)

The motor 8 is constituted by a stator 8*b* in a cylindrical tubular shape and a rotor 8*a* in a cylindrical columnar shape. The stator 8*b* is secured non-rotatably to the body shell 11*a* of the closed casing 11 by shrink fitting. The rotor 8*a* is disposed inside the stator 8*b*. The rotor 8*a* is freely rotatable about the stator 8*b*. A through hole penetrating through the rotor 8*a* in an axis direction is formed in plan view at the center of the rotor 8*a*. A main compressor shaft 38 extending vertically from the rotor 8*a* is inserted and secured in the through hole. The main compressor shaft 38 is rotated by the motor 8 being driven.

The lower end portion of the main compressor shaft 38 is supported freely rotatably by a secondary bearing member 71 in a substantially circular disk shape, which is secured to the body shell 11*a*. The secondary bearing member 71 is disposed inside the oil reservoir 16. One or a plurality of openings 71*a* is/are formed in the secondary bearing member 71 so that the refrigeration oil held in the oil reservoir 16 can flow above and below the secondary bearing member 71. The secondary bearing member 71 also serves as an oil level stabilizing plate for stabilizing the oil level.

An oil pump 72 as an oil supply unit is disposed at the lower end portion of the main compressor shaft 38. The refrigeration oil held in the oil reservoir 16 is drawn by the oil pump 72, and the refrigeration oil is supplied through an oil supply hole (not shown) formed inside the main compressor shaft 38 to the main compression mechanism 3. This enables lubrication and sealing of the main compression mechanism 3. The refrigeration oil supplied to the main compression mechanism 3 returns to the oil reservoir 16 through, for example, the gap between the rotor 8*a* and the stator 8*b*.

As illustrated in FIG. 1, the main compression mechanism 3 is a scroll-type compression mechanism. The main compression mechanism 3 is secured to the body shell 11*a* of the closed casing 11. The main compression mechanism 3 has a stationary scroll 32, an orbiting scroll 33, an Oldham ring 34, a bearing member 35, and a muffler 36.

The stationary scroll 32 is attached non-displacably to the body shell 11*a* of the closed casing 11. A wrap 32*a* in a spiral shape in plan view (for example, in an involute shape) is formed on the lower face of the stationary scroll 32. The orbiting scroll 33 is disposed so as to face the stationary scroll 32. A wrap 33*a* in a spiral shape in plan view (for example, in an involute shape), which meshes with the wrap 32*a*, is formed in a mid portion of the face of the orbiting scroll 33 that opposes the stationary scroll 32. A crescent-shaped working chamber (compression chamber) 39 is formed between the wrap 32*a* and the wrap 33*a*. An opening 32*d* that opens toward the working chamber 39 is formed in the stationary scroll 32. A suction pipe 32*c* is attached to the opening 32*d*. The suction pipe 32*c* is connected to a discharge pipe 51 by a connecting pipe 70, as illustrated in FIG. 2. The refrigerant is supplied through the connecting pipe 70 and the suction pipe 32*c* to the working chamber 39.

The peripheral portion of the opposing surface of the orbiting scroll 33 abuts against and is supported by a thrust bearing 32*b*, which is provided so as to protrude from the peripheral portion of the lower surface of the stationary scroll 32.

An eccentric portion 38*a*, which is provided at an upper end portion of the main compressor shaft 38 extending from the rotor 8*a* and has a different central axis from that of the main compressor shaft 38, is fitted and secured in a central portion of the lower face of the orbiting scroll 33. The Oldham ring 34 is disposed below the orbiting scroll 33. The Oldham ring 34 is for restricting self-rotation of the orbiting scroll 33. Owing to this function of the Oldham ring 34, the orbiting scroll 33 undergoes an orbiting motion in association with rotation of the main compressor shaft 38, in an off-centered state from the central axis of the main compressor shaft 38.

The working chamber 39 formed between the wrap 32*a* and the wrap 33*a* moves from outside to inside, in association with the orbiting motion of the orbiting scroll 33. In accordance with this movement, the volumetric capacity of the working chamber 39 reduces. Thereby, the refrigerant drawn from the suction pipe 32*c* into the working chamber 39 is compressed. Then, the compressed refrigerant passes through a discharge port 32*e* formed at the central portion of the stationary scroll 32 and an internal space 36*a* of the muffler 36, and it is discharged to an internal space 11*e* of the closed casing 11 through a discharge passage 40 that penetrates through the stationary scroll 32 and the bearing member 35. The discharged refrigerant temporarily stays in the internal space 11*e*. During that staying period, the refrigeration oil and the like mixed in the refrigerant are separated therefrom by gravitational force or centrifugal force. Then, the refrigerant from which the refrigeration oil and the like have been separated is discharged through a discharge pipe 11*d* attached to the upper shell 11*b* of the closed casing 11 to the refrigerant circuit 9.

(Power Recovery Unit 7)

As illustrated in FIGS. 1 and 2, the power recovery unit 7 is disposed in the oil reservoir 16. The power recovery unit 7 is constituted by the power recovery mechanism 5 disposed in a relatively lower part and the sub compression mechanism 2 disposed in a relatively upper part. The power recovery mechanism 5 and the sub compression mechanism 2 are disposed integrally via the power recovery shaft 12 and a first closing member 15. The power recovery unit 7 is secured to the body shell 11*a* by the third closing member 14, which is a component of the sub compression mechanism 2.

—Configuration of the Power Recovery Mechanism 5—

As illustrated in FIG. 1, the power recovery mechanism 5 has the first closing member 15 and a second closing member 13. The first closing member 15 and the second closing member 13 are opposed to each other. A first cylinder 22 is disposed between the first closing member 15 and the second closing member 13. The first cylinder 22 has an internal space in a substantially cylindrical tubular shape. The internal space of the first cylinder 22 is closed by the first closing member 15 and the second closing member 13.

The power recovery shaft 12 penetrates through the first cylinder 22 in an axis direction of the first cylinder 22. The power recovery shaft 12 is disposed on the central axis of the first cylinder 22. The power recovery shaft 12 is supported by the just-described second closing member 13 and the later-described third closing member 14. An oil supply hole 12*a* (see FIGS. 3 and 4), which penetrates through the power recovery shaft 12 in an axis direction, is formed in the power recovery shaft 12. The refrigeration oil in the closed casing 11 is supplied through this oil supply hole 12*a* to the bearings, gaps, and the like of the sub compression mechanism 2 and the power recovery mechanism 5.

A first piston 21 is disposed in an internal space in a substantially cylindrical tubular shape that is formed by the inner circumferential surface of the first cylinder 22, the first closing member 15, and the second closing member 13. The first piston 21 is fitted to the power recovery shaft 12 in an off-centered state with respect to the central axis of the power recovery shaft 12. Specifically, the power recovery shaft 12 has an eccentric portion 12*b*, which has the central axis that is different from the central axis of the rest of the power recovery shaft 12. The first piston 21 in a tubular shape is fitted to this eccentric portion 12*b*. Accordingly, the first piston 21 is off-centered with respect to the central axis of the first cylinder 22. Thus, the first piston 21 undergoes eccentric rotational motion in association with the rotation of the power recovery shaft 12.

Figure 3:
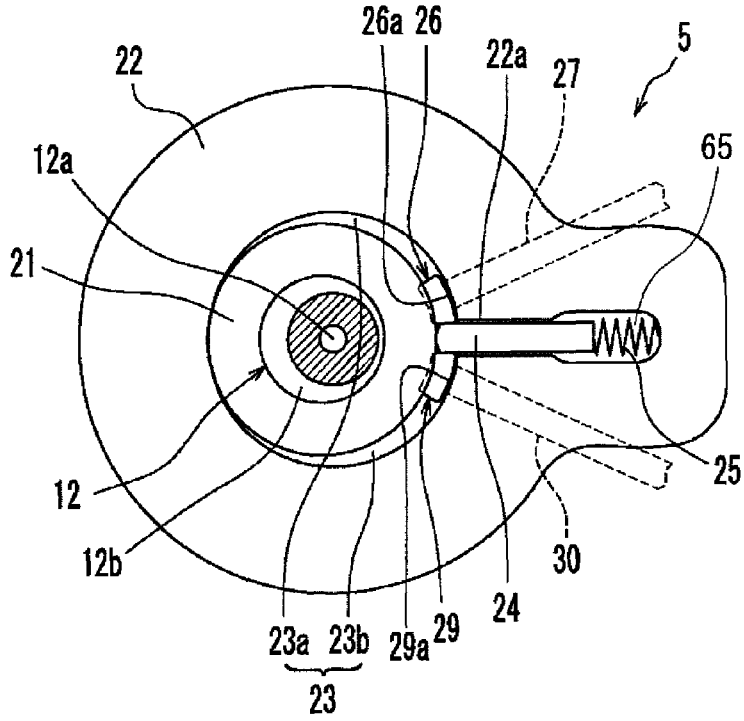
FIG. 3 is a cross-sectional view taken along line III-III in FIG. 1.

A first working chamber 23 is formed in the first cylinder 22 by the first piston 21, the inner circumferential surface of the first cylinder 22, the first closing member 15, and the second closing member 13 (see also FIG. 3).

As illustrated in FIG. 3, a linear line groove 22*a* that opens toward the first working chamber 23 is formed in the first cylinder 22. A first partitioning member 24 in a plate-like shape is inserted slidably in the linear groove 22*a*. A biasing means 25 is disposed between the first partitioning member 24 and the bottom portion of the linear groove 22*a*. The first partitioning member 24 is pressed against the outer circumferential surface of the first piston 21 by the biasing means 25. Thereby, the first working chamber 23 is partitioned into two spaces. Specifically, the first working chamber 23 is partitioned into a high-pressure side suction working chamber 23*a* and a low-pressure side discharge working chamber 23*b*.

The biasing means 25 may be constituted by, for example, a spring. Specifically, the biasing means 25 may be a compression coil spring.

The biasing means 25 may be what is called a gas spring or the like. That is, the pressure in the space between the first partitioning member 24 and the bottom portion of the linear groove 22*a* may be set to be higher than the pressure of the first working chamber 23 when the first partitioning member 24 slides in a direction such that the volume of a rear space 65 of the first partitioning member 24 decreases, and due to the pressure difference, a pressing force may act against the first partitioning member 24 in a direction toward the first piston 21. Specifically, for example, the rear space 65 of the first partitioning member 24 may be a closed space such that a reaction force acts against the first partitioning member 24 when the volume of the rear space 65 is decreased by the first partitioning member 24. Of course, the biasing means 25 may be constituted by a plurality of types of springs, such as a compression coil spring and a gas spring. It should be noted that the pressure of the first working chamber 23 refers to an average pressure between the pressure of the suction working chamber 23*a* and the pressure of the discharge working chamber 23*b*.

As illustrated in FIG. 3, a suction passage 27 opens in a portion of the suction working chamber 23*a*. That portion of the suction working chamber 23*a* is adjacent to the first partitioning member 24. As illustrated in FIG. 1, this suction passage 27 is formed in the second closing member 13, which is located below the first cylinder 22. The suction passage 27 is in communication with a suction pipe 28. The high pressure refrigerant supplied from the radiator 4, shown in FIG. 2, is guided to the suction working chamber 23*a* through the suction pipe 28 and the suction passage 27.

An opening (suction port) 26 of the suction passage 27, which is toward the suction working chamber 23*a*, is formed in a substantially sectoral shape extending in a circular arc shape from the portion of the suction working chamber 23*a* adjacent to the first partitioning member 24 in a direction in which the suction working chamber 23*a* stretches. The suction port 26 is closed completely by the first piston 21 only at the time when the first piston 21 is located at the top dead center. At least a portion of the suction port 26 is exposed to the suction working chamber 23*a* over the entire period except for the moment at which the first piston 21 is located at the top dead center. Specifically, when viewed in plan, an outer peripheral edge 26*a* of the suction port 26 is formed in a circular arc shape along the outer circumferential surface of the first piston 21 located at the top dead center. In other words, the outer peripheral edge 26*a* is formed in a circular arc shape having substantially the same radius as that of the outer circumferential surface of the first piston 21.

On the other hand, a discharge passage 30 opens in a portion of the discharge working chamber 23*b*. That portion of the discharge working chamber 23*b* is adjacent to the first partitioning member 24. As illustrated in FIG. 1, this discharge passage 30 is also formed in the second closing member 13, like the suction passage 27. The discharge passage 30 is in communication with a discharge pipe 31. Thereby, the refrigerant in the discharge working chamber 23*b* is discharged to the evaporator 6 side through the discharge passage 30 and the discharge pipe 31.

An opening (discharge port) 29 of the discharge passage 30, which is toward the discharge working chamber 23*b*, is formed in a substantially sectoral shape extending in a circular arc shape from the portion of the discharge working chamber 23*b* adjacent to the first partitioning member 24 in a direction in which the discharge working chamber 23*b* stretches. The discharge port 29 is closed completely by the first piston 21 only at the time when the first piston 21 is located at the top dead center. At least a portion of the discharge port 29 is exposed to the discharge working chamber 23*b* over the entire period except for the moment at which the first piston 21 is located at the top dead center. Specifically, when viewed in plan, an outer peripheral edge 29*a* of the discharge port 29, which is located on an outer side with respect to a radial direction of the first cylinder 22, is formed in a circular arc shape along the outer circumferential surface of the first piston 21 located at the top dead center. In other words, the outer peripheral edge 29*a* is formed in a circular arc shape having substantially the same radius as that of the outer circumferential surface of the first piston 21.

Figure 5:
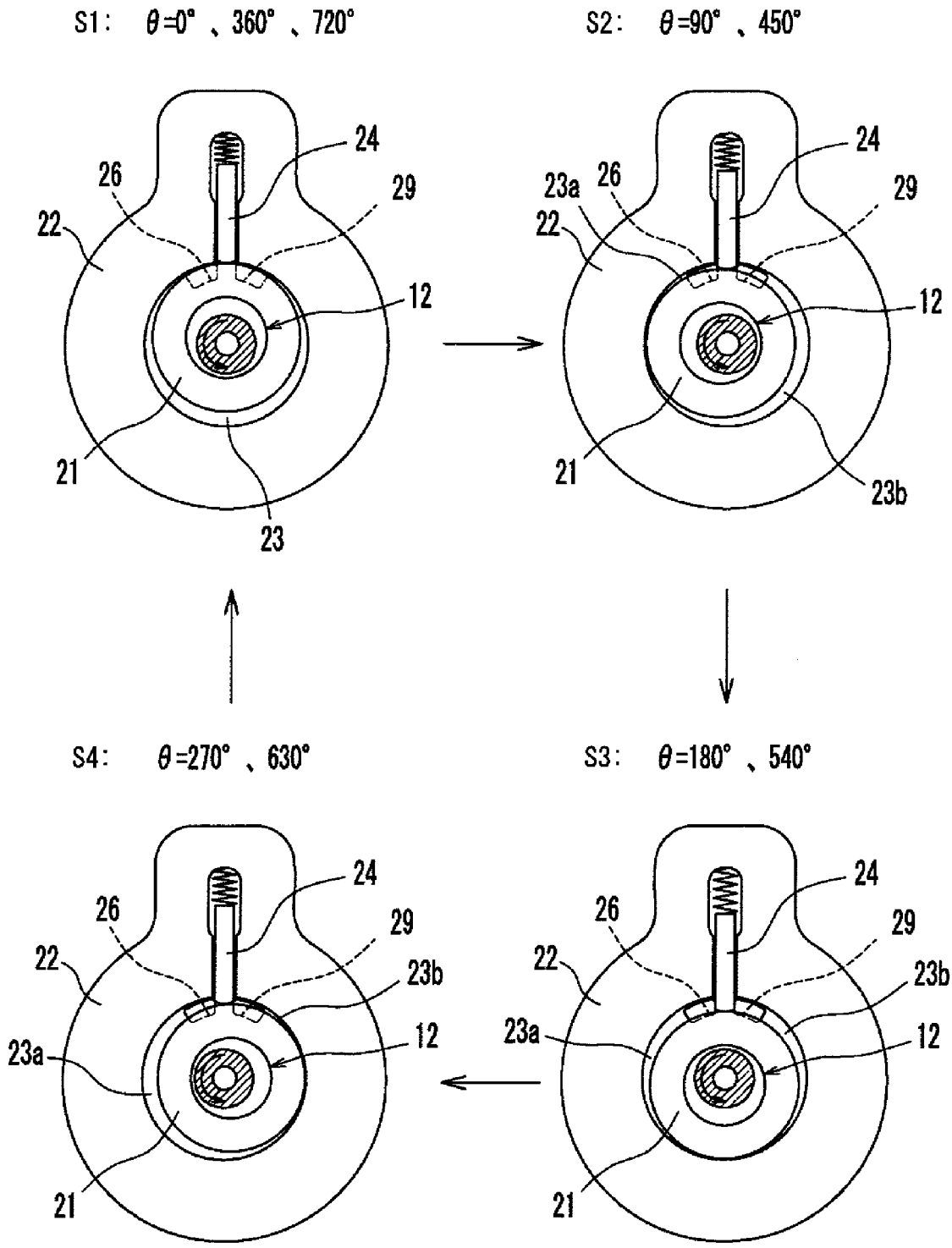
FIG. 5 is a view illustrating the operation principle of a power recovery mechanism.

It should be noted that the phrase "when the first piston 21 is located at the top dead center" means the time when the first partitioning member 24 is pressed into the linear groove 22*a* to the maximum, as illustrated in FIG. 5 (S1). In addition, "the moment at which the first piston 21 is located at the top dead center" may not be strictly limited to the moment at which the first piston 21 is located at the top dead center, but may be a certain period of time including the moment at which the first piston 21 is located at the top dead center. Specifically, for example, with the rotation angle (θ) of the first piston 21 at which the first piston 21 is located at the top dead center being defined as 0°, a configuration in which both the suction port 26 and the discharge port 29 are closed over a period in which the rotation angle (θ) of the first piston 21 is within 0°±5° (or within 0°±3°) also is included in the configuration in which the refrigerant does not blow through from the suction passage 27 to the discharge passage 30.

By forming the suction passage 27 and the discharge passage 30 in the above-described manner, both the suction port 26 and the discharge port 29 are closed completely, as illustrated in FIG. 5 (S1), only at the moment at which the first piston 21 is located at the top dead center. In other words, both the suction port 26 and the discharge port 29 are closed completely at the moment when the first working chamber 23 becomes one chamber. More specifically, the suction working chamber 23*a* is in communication with the suction passage 27 until the moment at which the suction working chamber 23*a* is brought into communication with the discharge passage 30. Then, the suction port 26 is closed by the first piston 21 after the moment at which the suction working chamber 23*a* is brought into communication with the discharge passage 30 and the suction working chamber 23*a* is turned into the discharge working chamber 23*b*. As a result, the blow-through of refrigerant from the suction passage 27 to the discharge passage 30 is prevented. Thus, highly efficient power recovery is accomplished.

From the viewpoint of completely restricting the blow-through of refrigerant from the suction passage 27 to the discharge passage 30, it is preferable that both the suction port 26 and the discharge port 29 be closed at the moment at which the first piston 21 is located at the top dead center. However, even when only one of the suction port 26 and the discharge port 29 is closed the moment at which the first piston 21 is located at the top dead center, the blow-through does not substantially occur between the suction passage 27 and the discharge passage 30 if the difference between the time at which the suction port 26 is closed and the time at which the discharge port 29 is closed is less than about 10°, in terms of the rotation angle of the power recovery shaft 12. In other words, the blow-through of refrigerant from the suction passage 27 to the discharge passage 30 can be suppressed by setting the difference between the time at which the suction port 26 is closed and the time at which the discharge port 29 is closed to be less than about 10° in terms of the rotation angle of the power recovery shaft 12.

As mentioned above, the suction working chamber 23*a* is in communication with the suction passage 27 at all times. Also, the discharge working chamber 23*b* is in communication with the discharge passage 30 at all times. In other words, in the power recovery mechanism 5, the process for drawing the refrigerant and the process for discharging the drawn refrigerant are performed in a substantially continuous manner. The power recovery mechanism 5 does not have a particular volumetric capacity ratio, and the ratio between the suction volume and the discharge volume is 1. Therefore, the drawn refrigerant passes through the power recovery mechanism 5 without any substantial change in volume.

—Operation of the Power Recovery Mechanism 5—

Next, the operation principle of the power recovery mechanism 5 will be described in detail with reference to FIG. 5. FIG. 5 (S1) is a view illustrating the time when the rotation angle (θ) of the first piston 21 is 0°, 360°, or 720°. FIG. 5 (S2) is a view illustrating the time when the rotation angle (θ) of the first piston 21 is 90° or 450°. FIG. 5 (S3) is a view illustrating the time when the rotation angle (θ) of the first piston 21 is 180° or 540°. FIG. 5 (S4) is a view illustrating the time when the rotation angle (θ) of the first piston 21 is 270° or 630°. It should be noted that the rotation angles (θ) are those when the anticlockwise direction in FIG. 5 is taken as positive.

As illustrated in FIG. 5 (S1), when the first piston 21 is located at the top dead center (θ=0°), both the suction port 26 and the discharge port 29 are closed by the first piston 21. Therefore, the first working chamber 23 is in an isolated state, in which the first working chamber 23 is in communication with neither the suction passage 27 nor the discharge passage 30.

The first piston 21 rotates from this state, whereby the suction working chamber 23*a* that is in communication with the suction passage 27 through the suction port 26 is formed. Here, the suction working chamber 23*a* is connected to the high pressure side of the refrigerant circuit 9. For this reason, when the suction port 26 opens, the volumetric capacity of the suction working chamber 23*a* gradually increases by the high pressure refrigerant flowing in from the suction port 26, as illustrated in FIG. 5 (S2) to (S4). The rotation torque according to this volumetric capacity increase of the suction working chamber 23*a*, which acts on the first piston 21, becomes a part of the rotation drive force of the power recovery shaft 12. This refrigerant suction process is performed until the rotation angle (θ) reaches 360°, i.e., until the first piston 21 is located again at the top dead center. In other words, the refrigerant suction process is performed until the time just before the suction working chamber 23*a* is brought into communication with the discharge passage 30.

In this embodiment, as illustrated in FIG. 5 (S1), when the first piston 21 is located again at the top dead center, both of the suction port 26 and the discharge port 29 are closed by the first piston 21. Thereby, the first working chamber 23 is isolated again.

As the first piston 21 rotates from this state, the first working chamber 23, which has been isolated, is brought into communication with the discharge passage 30 through the discharge port 29 and turned into the discharge working chamber 23*b*. Here, with the power recovery mechanism 5 being the boundary, the evaporator 6 side is at a lower pressure than the radiator 4 side due to the working of the main compression mechanism 3. Thus, the low temperature and high pressure refrigerant in the discharge working chamber 23*b* is sucked into the low pressure side at the moment at which the isolated first working chamber 23 is brought into communication with the discharge passage 30 through the discharge port 29 and turned to the discharge working chamber 23*b*. As a result, the refrigerant in the first working chamber 23 expands. Then, the pressure in the discharge working chamber 23*b* becomes equal to the pressure of the low pressure side of the refrigerant circuit 9. Because of this refrigerant discharge process, the rotation torque that acts on the first piston 21 also becomes a part of the rotation drive force of the power recovery shaft 12. That is, the power recovery shaft 12 is rotated by the inflow of the high pressure refrigerant into the suction working chamber 23*a* and the aspiration of the refrigerant in the discharge process. This rotation torque of the power recovery shaft 12 is utilized as the motive power for the sub compression mechanism 2, as will be discussed later.

Further, as the rotation angle (θ) of the first piston 21 increases, the refrigerant in the discharge working chamber 23*b* is discharged gradually to the low pressure side of the refrigerant circuit 9. Then, as illustrated in FIG. 5 (S1), when the first piston 21 is located again at the top dead center (θ=720°), the discharge working chamber 23*b* disappears. In synchronization with this discharge process, the suction working chamber 23*a* is formed again, and the next suction process is performed. As described above, a series of processes from the start of the suction process to the end of the discharge process completes when the first piston 21 has rotated 720°.

—Configuration of the Sub Compression Mechanism 2—

The sub compression mechanism 2 is coupled to the power recovery mechanism 5 by the power recovery shaft 12. In other words, the power recovery shaft 12 of the power recovery mechanism 5 also serves as the shaft of the sub compression mechanism 2. Also in other words, the shaft of the power recovery mechanism 5 and the shaft of the sub compression mechanism 2 are coupled integrally.

The basic configuration of the sub compression mechanism 2 is substantially the same as that of the power recovery mechanism 5. Specifically, as illustrated in FIG. 1, the sub compression mechanism 2 has the first closing member 15 and a third closing member 14. The first closing member 15 is a component shared between the sub compression mechanism 2 and the power recovery mechanism 5. The first closing member 15 and the third closing member 14 are opposed to each other. Specifically, the third closing member 14 is opposed to a face of the first closing member 15. The face is opposite another face opposed to the second closing member 13. A second cylinder 42 is disposed between the first closing member 15 and the third closing member 14. The second cylinder 42 has an internal space in a substantially cylindrical tubular shape. The internal space of the second cylinder 42 is closed by the first closing member 15 and the third closing member 14.

The power recovery shaft 12 penetrates through the second cylinder 42 in an axis direction of the second cylinder 42. The power recovery shaft 12 is disposed on the central axis of the second cylinder 42. A second piston 41 is disposed in an internal space in a substantially cylindrical tubular shape that is formed by the inner circumferential surface of the second cylinder 42, the first closing member 15, and the third closing member 14. The second piston 41 is fitted to the power recovery shaft 12 in an off-centered state with respect to the central axis of the power recovery shaft 12. Specifically, the power recovery shaft 12 has an eccentric portion 12*c*, which has the central axis that is different from the central axis of the power recovery shaft 12. The second piston 21 in a tubular shape is fitted to this eccentric portion 12*c*. Accordingly, the second piston 41 is off-centered with respect to the central axis of the second cylinder 42. Thus, the second piston 41 undergoes eccentric rotational motion in association with rotation of the power recovery shaft 12.

It should be noted that the eccentric portion 12*c*, to which the second piston 41 is attached, is off-centered in substantially the same direction as is the eccentric portion 12*b*, to which the first piston 21 is attached. Thus, in the present embodiment, the eccentric direction of the first piston 21 with respect to the central axis of the first cylinder 22 and that of the second piston 41 with respect to the central axis of the second cylinder 42 are substantially the same as each other.

Figure 4:
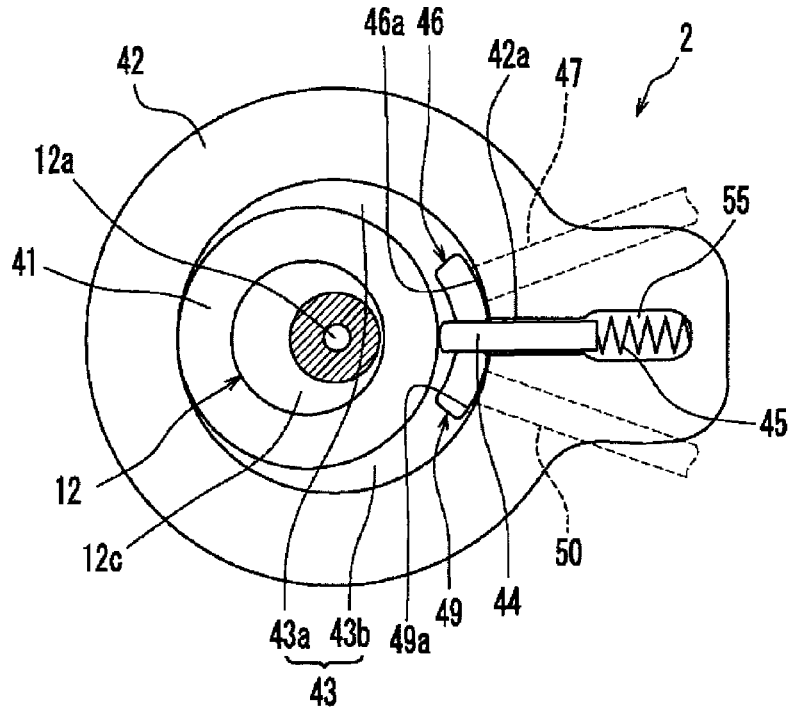
FIG. 4 is a cross-sectional view taken along line IV-IV in FIG. 1.

A second working chamber 43 is formed in the second cylinder 42 by the second piston 41, the inner circumferential surface of the second cylinder 42, the first closing member 15, and the third closing member 14 (see also FIG. 4).

As illustrated in FIG. 4, a linear line groove 42*a* that opens toward the second working chamber 43 is formed in the second cylinder 42. A second partitioning member 44 in a plate-like shape is inserted slidably in the linear groove 42*a*. A biasing means 45 is disposed between the second partitioning member 44 and the bottom part of the linear groove 42*a*. The second partitioning member 44 is pressed against the outer circumferential surface of the second piston 41 by the biasing means 45. Thereby, the second working chamber 43 is partitioned into two spaces. Specifically, the second working chamber 43 is partitioned into a low-pressure side suction working chamber 43*a* and a high-pressure side discharge working chamber 43*b*.

The biasing means 45 may be constituted by, for example, a spring. Specifically, the biasing means 45 may be a compression coil spring.

The biasing means 45 may be what is called a gas spring or the like. That is, the pressure in a rear space 55 may be set to be higher than the pressure of the second working chamber 43 when the second partitioning member 44 slides in a direction such that the volume of the rear space 55 decreases, and due to the pressure difference between the rear space 55 and the second working chamber 43, a pressing force may act against the second partitioning member 44 in a direction toward the second piston 41. Specifically, for example, the rear space 55 may be a closed space such that a reaction force acts against the second partitioning member 44 when the volume of the rear space 65 is decreased by the second partitioning member 44. Alternatively, it is also possible that the rear space 55 may be a closed space when the second partitioning member 44 is away from the second piston 41 to a certain degree, while the rear space 55 may not be a closed space when the second partitioning member 44 is located closest to the second piston 41. Of course, the biasing means 45 may be constituted by a plurality of types of springs, such as a compression coil spring and a gas spring. It should be noted that the pressure of the second working chamber 43 refers to an average pressure between the pressure of the suction working chamber 43*a* and the pressure of the discharge working chamber 43*b*.

As illustrated in FIG. 4, a suction passage 47 opens in a portion of the suction working chamber 43*a*. That portion of the suction working chamber 43*a* is adjacent to the second partitioning member 44. As illustrated in FIG. 1, this suction passage 47 is formed in the third closing member 14, which is located below the second cylinder 42. The suction passage 47 is in communication with a suction pipe 48. The refrigerant supplied from the radiator 6 (see FIG. 2) is guided to the suction working chamber 43*a* through the suction pipe 48 and the suction passage 47.

As illustrated in FIG. 4, an opening (suction port) 46 of the suction passage 47, which is toward the suction working chamber 43*a*, is formed in a substantially sectoral shape extending in a circular arc shape from the portion of the suction working chamber 43*a* adjacent to the second partitioning member 44 in a direction in which the suction working chamber 43*a* stretches. The suction port 46 is closed completely by the second piston 41 only at the time when the second piston 41 is located at the top dead center. At least a portion of the suction port 46 is exposed to the suction working chamber 43*a* over the entire period except for the moment at which the second piston 41 is located at the top dead center. Specifically, when viewed in plan, an outer peripheral edge 46*a* of the suction port 46, which is located on an outer side with respect to a radial direction of the second cylinder 42, is formed in a circular arc shape along the outer circumferential surface of the second piston 41 located at the top dead center. In other words, the outer peripheral edge 46*a* is formed in a circular arc shape having substantially the same radius as that of the outer circumferential surface of the second piston 41.

On the other hand, a discharge passage 50 opens in a portion of the discharge working chamber 43*b*. That portion of the discharge working chamber 43*b* is adjacent to the second partitioning member 44. As illustrated in FIG. 1, this discharge passage 50 is also formed in the third closing member 14, like the suction passage 47. The discharge passage 50 is in communication with a discharge pipe 51. Thereby, the refrigerant in the discharge working chamber 43*b* is discharged to the main compression mechanism 3 side through the discharge passage 50 and the discharge pipe 51. The refrigerant discharged to the main compression mechanism 3 side is supplied to the main compression mechanism 3 through the connecting pipe 70 and the suction pipe 32*c*.

An opening (discharge port) 49 of the discharge passage 50, which is toward the discharge working chamber 43*b*, is formed in a substantially sectoral shape extending in a circular arc shape from the portion of the discharge working chamber 43*b* adjacent to the second partitioning member 44 in a direction in which the discharge working chamber 43*b* stretches. The discharge port 49 is closed completely by the second piston 41 only at the time when the second piston 41 is located at the top dead center. At least a portion of the discharge port 49 is exposed to the discharge working chamber 43*b* over the entire period except for the moment at which the second piston 41 is located at the top dead center. Specifically, when viewed in plan, an outer peripheral edge 49*a* of the discharge port 49, which is located on an outer side with respect to a radial direction of the second cylinder 42, is formed in a circular arc shape along the outer circumferential surface of the second piston 41 located at the top dead center. In other words, the outer peripheral edge 49*a* is formed in a circular arc shape having substantially the same radius as that of the outer circumferential surface of the second piston 41.

Figure 6:
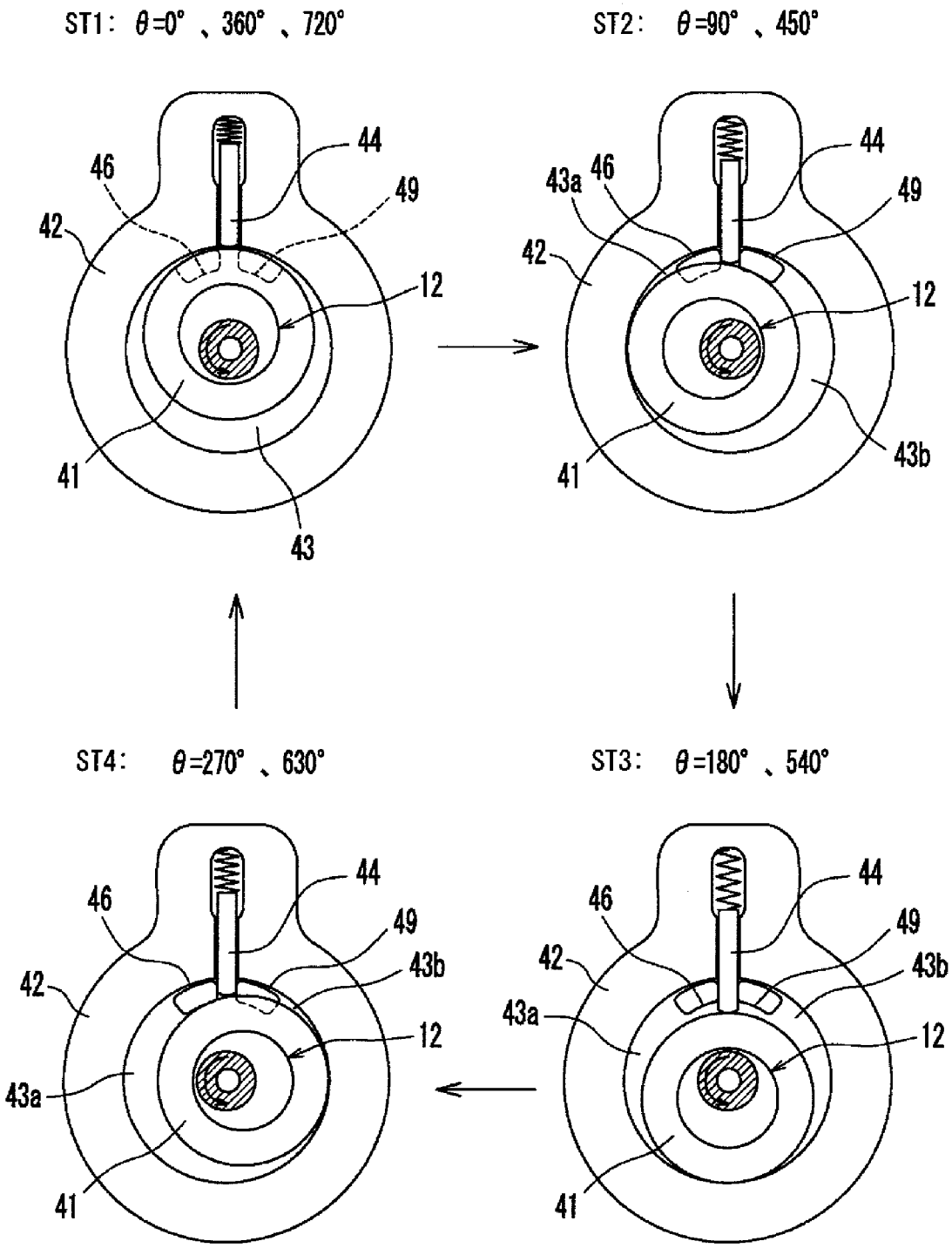
FIG. 6 is a view illustrating the operation principle of a sub compression mechanism.

It should be noted that the phrase "when the second piston 41 is located at the top dead center" means the time when the second partitioning member 44 is pressed into the linear groove 42*a* to the maximum, as illustrated in FIG. 6 (ST1). In addition, "the moment at which the second piston 41 is located at the top dead center" may not be strictly limited to the moment at which the second piston 41 is located at the top dead center, but may be a certain period of time including the moment at which the second piston 41 is located at the top dead center. Specifically, for example, with the rotation angle (θ) of the second piston 41 at which the second piston 41 is located at the top dead center being defined as 0°, a configuration in which both the suction port 46 and the discharge port 49 are closed over a period in which the rotation angle (θ) of the second piston 41 is within 0°±5° (or within 0°±3°) also is included in the configuration in which the refrigerant does not blow through from the suction passage 47 to the discharge passage 50.

By forming the suction passage 47 and the discharge passage 50 in the above-described manner, both the suction port 46 and the discharge port 49 are closed completely, as illustrated in FIG. 6 (ST1), only at the moment at which the second piston 41 is located at the top dead center. In other words, both the suction port 46 and the discharge port 49 are closed completely at the moment when the second working chamber 43 becomes one chamber. More specifically, the suction working chamber 43*a* is in communication with the suction passage 47 until the moment at which the suction working chamber 43*a* is brought into communication with the discharge passage 50. Then, the suction port 46 is closed by the second piston 41 after the moment at which the suction working chamber 43*a* is brought into communication with the discharge passage 50 and the suction working chamber 43*a* is turned into the discharge working chamber 43*b*. This inhibits the backflow of the refrigerant from the discharge passage 50 with a relatively high pressure to the suction passage 47 with a relatively low pressure. Thus, highly efficient supercharging is accomplished. As a result, the utilization efficiency of the recovered motive power is enhanced.

From the viewpoint of completely restricting the backflow of refrigerant from the discharge passage 50 to the suction passage 47, it is preferable that both the suction passage 47 and the discharge passage 50 be closed at the moment at which the second piston 41 is located at the top dead center. However, even when only one of the suction port 46 and the discharge port 49 is closed the moment at which the second piston 41 is located at the top dead center, the backflow of the refrigerant does not substantially occur from the discharge passage 50 to the suction passage 47 if the difference between the time at which the suction port 46 is closed and the time at which the discharge port 49 is closed is less than about 10°, in terms of the rotation angle of the power recovery shaft 12. In other words, the backflow of the refrigerant from the discharge passage 50 to the suction passage 47 can be suppressed by setting the difference between the time at which the suction port 46 is closed and the time at which the discharge port 49 is closed to be less than about 10° in terms of the rotation angle of the power recovery shaft 12.

As mentioned above, the suction working chamber 43*a* is in communication with the suction passage 47 at all times. Also, the discharge working chamber 43*b* is in communication with the discharge passage 50 at all times. In other words, in the sub compression mechanism 2, the process for drawing the refrigerant and the process for discharging the drawn refrigerant are performed in a substantially continuous manner. The sub compression mechanism 2 does not have a particular volumetric capacity ratio, and the ratio between the suction volume and the discharge volume is 1. Therefore, the drawn refrigerant passes through the sub compression mechanism 2 without any substantial change in volume.

—Operation of the Sub Compression Mechanism 2—

Next, the operation principle of the sub compression mechanism 2 will be described in detail with reference to FIG. 6. FIG. 6 (ST1) is a view illustrating the time when the rotation angle (θ) of the second piston 41 is 0°, 360°, or 720°. FIG. 6 (ST2) is a view illustrating the time when the rotation angle (θ) of the second piston 41 is 90° or 450°. FIG. 6 (ST3) is a view illustrating the time when the rotation angle (θ) of the second piston 41 is 180° or 540°. FIG. 6 (ST4) is a view illustrating the time when the rotation angle (θ) of the second piston 41 is 270° or 630°. It should be noted that the rotation angles (θ) are those when the anticlockwise direction in FIG. 6 is taken as positive.

As described above, the power recovery shaft 12 is rotated by the motive power recovered by the power recovery mechanism 5. The second piston 41 rotates in association with this rotation of the power recovery shaft 12 to drive the sub compression mechanism 2.

As illustrated in FIG. 6 (ST1), when the second piston 41 is located at the top dead center (θ=0°), both the suction port 46 and the discharge port 49 are closed by the second piston 41. Therefore, the second working chamber 43 is in communication with neither the suction passage 47 nor the discharge passage 50 (see FIG. 4), and the second working chamber 43 is in an isolated state.

The second piston 41 rotates from this state, whereby the suction working chamber 43*a* that is in communication with the suction passage 47 through the suction port 46 is formed. As the rotation angle (θ) increases, the suction working chamber 43*a* expands until the rotation angle (θ) of the second piston 41 reaches 360°. When the rotation angle (θ) reaches 360°, the suction process of the refrigerant completes.

Until the rotation angle (θ) reaches 360°, the suction working chamber 43*a* is in communication with the suction passage 47 at all times. When the rotation angle (θ) reaches 360°, the suction passage 47 is closed by the second piston 41. When the rotation angle (θ) is 360°, the discharge passage 50 also is closed. That is, the second working chamber 43 is separated from both the suction passage 47 and the discharge passage 50 and is isolated. When the piston rotates further and the rotation angle (θ) exceeds 360°, the second working chamber 43 is brought into communication with the discharge passage 50 through the discharge port 49 and turned into the discharge working chamber 43*b*. Then, when the rotation angle (θ) of the second piston 41 becomes greater than 360°, the capacity of the discharge working chamber 43*b* decreases. Simultaneously, the refrigerant is discharged from the discharge working chamber 43*b* to the main compression mechanism 3 side. Then, as illustrated in FIG. 6 (ST1), when the second piston 41 is located again at the top dead center (θ=720°), the discharge working chamber 43*b* disappears. Throughout this discharge process, the discharge working chamber 43*b* is in communication with the discharge passage 50 at all times. Then, in synchronization with this discharge process, the suction working chamber 43*a* is formed again, and the next suction process is performed. As described above, a series of processes from the start of the suction process to the end of the discharge process completes when the second piston 41 has rotated 720°.

As described above, the capacity of the second working chamber 43 is substantially invariable. In addition, the suction working chamber 43*a* is in communication with the suction passage 47 at all times. The discharge working chamber 43*b* is in communication with the discharge passage 50 at all times. For this reason, the refrigerant is neither compressed nor expanded in the second working chamber 43 of the sub compression mechanism 2. As much as the power recovery shaft 12 is rotated by the power recovery mechanism 5 and the sub compression mechanism 2 is driven, the pressure of the downstream side of the second working chamber 43 becomes higher than that of the upstream side of the second working chamber 43. In other words, because of the sub compression mechanism 2 driven by the motive power recovered by the power recovery mechanism 5, the pressure of the main compression mechanism 3 side from the discharge port 49 becomes higher than the pressure of the evaporator 6 side from the suction port 46. In other words, the sub compression mechanism 2 causes a pressure increase.

In the present embodiment, the time at which the first piston 21 of the power recovery mechanism 5 is located at the top dead center and the time at which the second piston 41 of the sub compression mechanism 2 is located at the top dead center are substantially the same as each other.

<<Refrigeration Cycle>>

Figure 7:
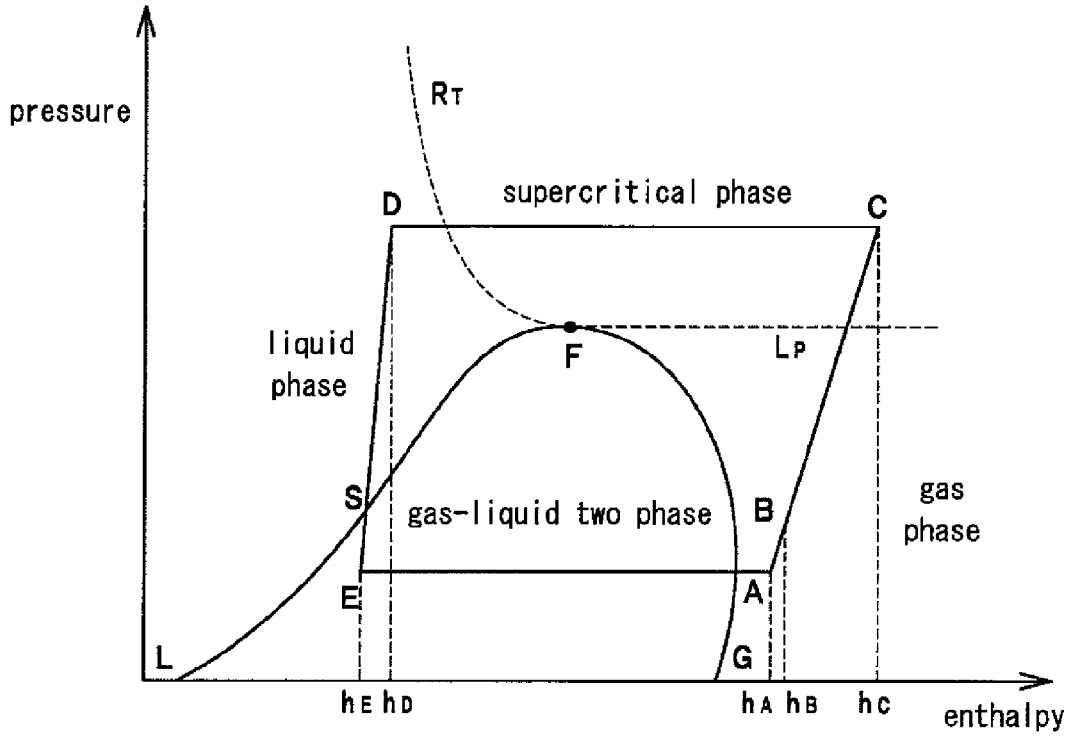
FIG. 7 is a Mollier diagram of the refrigeration cycle.

Next, the refrigeration cycle of the refrigeration cycle apparatus 1 will be described with reference to FIG. 7. The point F shown in FIG. 7 is a critical point. The curve F-L is a saturated liquid curve. The curve F-G is a saturated gas curve. The line $L_P$ is an isobaric line passing through the critical point F. The curve $R_T$ is an isothermal curve passing through the critical point F. In the Mollier diagram shown in FIG. 7, the region on the right of the saturated gas curve F-G and below the isobaric line $L_P$ represents a gas phase. The region on the left of the saturated liquid curve F-L and below the isothermal line $R_T$ represents a liquid phase. The region above the isobaric line $L_P$ and above the isothermal line $R_T$ represents a supercritical phase. The region on the right of the saturated liquid curve F-L and on the left of the saturated gas curve F-G represents gas-liquid two phase. In FIG. 7, $h_A$, $h_B$, $h_C$, $h_D$, and $h_E$ denote the enthalpies of the refrigerant at points A, B, C, D, and E, respectively.

The closed loop ABCDE in FIG. 7 represents the refrigeration cycle of the power recovery type refrigeration cycle apparatus 1 shown in FIG. 2. The segment A-B in the closed loop ABCDE denotes the state change of the refrigerant by the sub compression mechanism. The segment B-C denotes the state change of the refrigerant in the main compression mechanism 3. The segment C-D denotes the state change of the refrigerant in the radiator 4. The segment D-E denotes the state change of the refrigerant in the power recovery mechanism 5. The segment E-A denotes the state change of the refrigerant in the evaporator 6.

In the main compression mechanism 3, the refrigerant is compressed from a low pressure gas phase (point B) to a high pressure supercritical phase (point C). The refrigerant that has been compressed in the main compression mechanism 3 is cooled from a supercritical phase (point C) to a liquid phase (point D) in the radiator 4.

Thereafter, in the power recovery mechanism 5, the refrigerant expands (i.e., undergoes a pressure drop) from a low temperature and high pressure liquid phase (point D) to a gas-liquid two phase state (point E) via a saturated liquid (point S). In this process of pressure drop (expansion), the refrigerant is an incompressible liquid phase from point D to point S, so the specific volumetric capacity of the refrigerant does not change considerably. On the other hand, a pressure drop accompanying a significant change in specific volumetric capacity due to a phase change from a liquid phase to a gas phase, i.e., a pressure drop accompanying expansion, occurs in the period from point S to point E.

The refrigerant supplied from the power recovery mechanism 5 is heated in the evaporator 6, and it changes from a gas-liquid two phase state (point E) to a gas phase (point A) while it undergoes evaporation. The refrigerant heated by the evaporator 6 undergoes a pressure increase in the sub compression mechanism 2 and changes into a gas phase (point B).

<<Workings and Effects>>

In the present embodiment, the power recovery unit 7 is disposed inside the oil reservoir 16, which is provided in the closed casing 11 and which holds the refrigeration oil to be supplied to the main compression mechanism 3, as described above. In this way, oil reservoirs for supplying the refrigeration oil to the main compression mechanism 3 and the power recovery unit 7 can be integrated into a single oil reservoir.

For example, when an oil reservoir for the power recovery unit 7 is provided separately from an oil reservoir for the main compression mechanism 3, the refrigeration oil that flows out from one of the oil reservoirs to the refrigerant circuit 9 returns to the other oil reservoir, so the amount of the refrigeration oil held in the one of the oil reservoirs may decrease. If this happens, lubrication and sealing of the main compression mechanism 3 or the power recovery unit 7 may not be performed sufficiently.

In contrast, when a single oil reservoir is used in common between the main compression mechanism 3 and the power recovery unit 7 as in the present embodiment, the refrigeration oil that has flowed out circulates through the refrigerant circuit 9 and returns to the oil reservoir 16 again even if the refrigeration oil flows out from the oil reservoir 16 to the refrigerant circuit 9. This makes it possible to suppress the decrease in the amount of the refrigeration oil held in the oil reservoir 16. As a result, the refrigeration oil can be supplied stably to the main compression mechanism 3 and the power recovery unit 7. Thereby, an improvement in reliability of the refrigeration cycle apparatus 1 is achieved by appropriate lubrication to sliding parts of the main compression mechanism 3 and the power recovery unit 7. Moreover, the operation efficiency of the refrigeration cycle apparatus 1 can be improved because leaking gaps in the main compression mechanism 3 and the power recovery unit 7 can be sealed with high reliability.

In addition, in the present embodiment, the refrigerant compressed by the main compression mechanism 3 is discharged into the closed casing 11, and refrigeration oil is separated from the refrigerant in the closed casing 11. The separated refrigeration oil returns to the oil reservoir 16 again. Thus, the refrigeration oil mixed in the refrigerant is separated from the refrigerant in the closed casing 11, and returns to the oil reservoir 16, so the decrease in the refrigeration oil held in the oil reservoir 16 can be suppressed more effectively. As a result, the refrigeration oil can be supplied more stably to the main compression mechanism 3 and the power recovery unit 7.

In addition, by employing the configuration in which the refrigerant compressed by the main compression mechanism 3 is discharged temporarily into the closed casing 11, the pressure inside the closed casing 11 can be made relatively high. Thereby, the refrigeration oil can be supplied more easily to the main compression mechanism 3 through an oil supply hole formed in the main compressor shaft 38, which is not shown in the drawings. Moreover, infiltration of the refrigeration oil to the power recovery unit 7 is promoted. As a result, the refrigeration oil can be supplied to the main compression mechanism 3 and the power recovery unit 7 more reliably. This enhances the reliability of the refrigeration cycle apparatus 1 further, and improves the operation efficiency of the refrigeration cycle apparatus 1 further.

Moreover, employing the oil reservoir that is shared between the main compression mechanism 3 and the power recovery unit 7 eliminates the need for a special mechanism such as an oil balancing pipe for balancing the amounts of the refrigeration oil held in the oil reservoirs, which is necessary in such a case that the oil reservoir for the power recovery unit 7 is provided separately from the oil reservoir for the main compression mechanism 3. Therefore, the configuration of the refrigeration cycle apparatus 1 is simplified, and the manufacturing cost can be reduced.

Furthermore, by disposing the power recovery unit 7 in the oil reservoir 16, the need for a separate closed casing for the power recovery unit 7 is eliminated. Therefore, size reduction and cost reduction of the refrigeration cycle apparatus 1 can be achieved. In addition, using the first closing member 15 in common between the power recovery mechanism 5 and the sub compression mechanism 2 results in further size reduction of the fluid machine 10A and, accordingly, the refrigeration cycle apparatus 1.

In addition, as long as the power recovery unit 7 is disposed in the oil reservoir 16 as in the present embodiment, the design of the main compression mechanism 3 need not be changed and only one or both of the body shell 11*a* and the bottom shell 11*c* of the closed casing 11 should be changed. In other words, the main compression mechanism 3 can be designed freely regardless of the power recovery unit 7. As a result, a high level of freedom can be realized. Also, design costs can be reduced since the configuration of the present embodiment can be employed with changing only the shape of the closed casing 11 and without changing the designs of other parts considerably. Moreover, it is relatively easy to use common components with other refrigeration cycle apparatuses. As a result, it becomes possible to further cost reduction of the refrigeration cycle apparatus 1.

Moreover, in the present embodiment, the main compressor shaft 38 of the main compression mechanism 3 and the power recovery shaft 12 of the power recovery unit 7 are independent of each other. Therefore, the degree of freedom in designing the main compression mechanism 3 and the power recovery unit 7 becomes even higher. As a result, further cost reduction is achieved.

Figure 9:
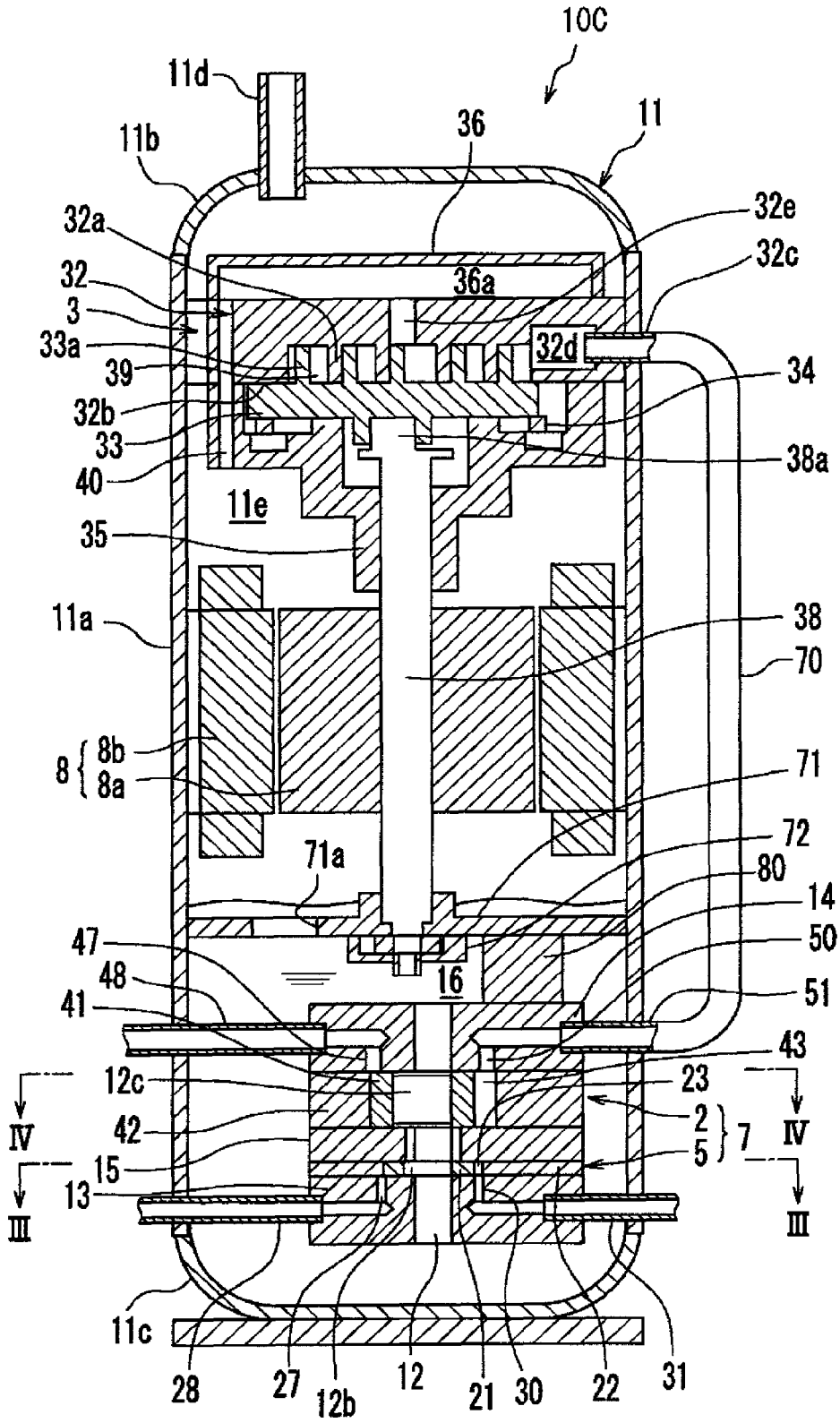
FIG. 9 is a cross-sectional view illustrating a fluid machine according to a modified example 2.

In addition, according to this configuration, it is unnecessary to dispose the main compressor shaft 38 and the power recovery shaft 12 in such a manner that the axial line of the main compressor shaft 38 and the axial line of the power recovery shaft 12 are located on a linear line (see also FIG. 9, for example). Thus, the degree of freedom in arrangement of the main compression mechanism 3 and the power recovery unit 7 also improves. As a result, the degree of freedom in designing the fluid machine 10A increases. What is more, further size reduction may be possible in certain cases.

From the viewpoint of improving the degree of freedom in design further, it is preferable that the power recovery unit 7 not be secured to the main compression mechanism 3 and the motor 8 but the power recovery unit 7 be secured to the closed casing 11 as in the present embodiment. In that way, it becomes easier to make the power recovery unit 7 and the unit of the main compression mechanism 3 and the motor 8 in common with other refrigeration cycle apparatuses 1. Thus, further reductions in development costs and manufacturing costs become possible.

In addition, in the present embodiment, the degree of freedom in the designing of the upper shell 11*b* and the bottom shell 11*c* is very high because the power recovery unit 7 is secured to the body shell 11*a*. Since the body shell 11*a* is in a tubular shape, it is relatively easy to increase the height. Accordingly, a particularly high degree of freedom in design can be accomplished by securing the power recovery unit 7 to the body shell 11*a*.

Moreover, an error in the distance between the suction pipe 32*c* and the discharge pipe 51 can be made small by securing the power recovery unit 7 to the body shell 11*a* and also securing the main compression mechanism 3 to the body shell 11*a*. This makes fitting of the connecting pipe 70 easier. As a result, a further cost reduction of the refrigeration cycle apparatus 1 is achieved.

Furthermore, the use of the connecting pipe 70 disposed outside the closed casing 11 makes it possible to connect the suction pipe 32*c* and the discharge pipe 51 to each other easily, regardless of the configurations of the main compression mechanism 3 and the power recovery unit 7. In addition, according to this configuration, design changes of the interior configuration of the closed casing 11 are substantially unnecessary, so it becomes easy for the main compression mechanism 3 and the power recovery unit 7 to have a common design with other the refrigeration cycle apparatuses 1.

In the present embodiment, motive power is recovered by the power recovery mechanism 5. The motive power recovered by the power recovery mechanism 5 is utilized as the motive power for the sub compression mechanism 2. Therefore, high energy efficiency is realized. Specifically, with reference to FIG. 7, in the power recovery mechanism 5, the energy corresponding to the enthalpy difference corresponding to $(h_D-h_E)$ is recovered from the refrigerant as the motive power. Approximately, the energy corresponding to the enthalpy $\eta_{exp}\cdot\eta_{pump}\ (h_D-h_E)=(h_B-h_A)$, which is obtained by multiplying this recovered enthalpy $(h_D-h_E)$ by the efficiency $\eta_{exp}$ of the power recovery mechanism 5 and the efficiency $\eta_{pump}$ of the sub compression mechanism 2, is given to the refrigerant by the sub compression mechanism 2. As a result, the pressure of the refrigerant is increased from point A to point B shown in FIG. 7.

For example, in a refrigeration cycle apparatus that is not provided with the sub compression mechanism 2, the main compression mechanism 3 compresses the refrigerant from point A, which is on the outlet side of the evaporator 6, to point C, which is on the inlet side of the radiator 4. In contrast, in the refrigeration cycle apparatus 1 of the present embodiment, which is provided with the sub compression mechanism 2 connected to the power recovery mechanism 5, the refrigerant is discharged from the sub compression mechanism 2 and thereby the pressure of the refrigerant is increased from point A and point B. Therefore, the main compression mechanism 3 needs to compress the refrigerant only from point B to point C. Accordingly, the workload of the main compression mechanism 3 can be reduced by the energy corresponding to $(h_B-h_A)$. As a result, the COP (coefficient of performance) of the refrigeration cycle apparatus 1 can be enhanced.

It should be noted that the difference between the pressure in the radiator 4 and the pressure in the evaporator 6 is relatively large when carbon dioxide is used as the refrigerant. Therefore, when carbon dioxide is used as the refrigerant, relatively large energy recovery is made possible and higher energy efficiency can be achieved by placing the power recovery mechanism 5 between the radiator 4 and the evaporator 6 as in the present embodiment.

It may seem conceivable to perform power recovery, for example, by connecting the power recovery shaft 12 of the power recovery mechanism 5 to the main compression mechanism 3, without providing the sub compression mechanism 2. However, the main compression mechanism 3 is at a significantly higher temperature than the power recovery mechanism 5. For this reason, heat exchange tends to take place easily between the main compression mechanism 3 and the power recovery mechanism 5 if the main compression mechanism 3 and the power recovery mechanism 5 are connected to each other. Specifically, the temperature of the main compression mechanism 3 lowers. As a result, the COP of the refrigeration cycle apparatus 1 drops. On the other hand, the sub compression mechanism 2 is not at as high a temperature as the main compression mechanism 3. For this reason, when the sub compression mechanism 2 and the power recovery mechanism 5 are connected to each other, heat exchange does not take place as much as when the main compression mechanism 3 and the power recovery mechanism 5 are connected to each other. Thus, when the sub compression mechanism 2 is provided separately from the main compression mechanism 3 and the sub compression mechanism 2 is connected to the power recovery mechanism 5 as in the present embodiment, a decrease in the COP of the refrigeration cycle apparatus 1 can be inhibited. In other words, the energy efficiency of the refrigeration cycle apparatus 1 can be improved.

Moreover, in the present embodiment, the sub compression mechanism 2 is disposed closer to the main compression mechanism 3, which is at a relatively high temperature, and the power recovery mechanism 5, which is at a relatively low temperature, is disposed at a location farther from the main compression mechanism 3 than the sub compression mechanism 2. As a result, the heat exchange between the main compression mechanism 3 and the power recovery mechanism 5 is inhibited effectively.

Furthermore, in the present embodiment, the power recovery unit 7 is secured to the closed casing 11 with the sub compression mechanism 2. Specifically, the power recovery unit 7 is secured to the closed casing 11 with the third closing member 14. Therefore, the heat from the closed casing 11 is not transferred to the power recovery mechanism 5 directly, but it is transferred via the sub compression mechanism 2. Accordingly, the sub compression mechanism 2 serves as a thermal resistance, inhibiting the heat conduction to the power recovery mechanism 5 via the closed casing 11 effectively.

It should be noted that a temperature increase of the sub compression mechanism 2 does not cause a serious problem, unlike the power recovery mechanism 5. When heat transfer occurs from the main compression mechanism 3 to the sub compression mechanism 2, the energy given to the refrigerant by the main compression mechanism 3 correspondingly reduces. However, the temperature of the refrigerant discharged from the sub compression mechanism 2 rises corresponding to the heat quantity transferred to the sub compression mechanism 2. In other words, although the energy given to the refrigerant in the main compression mechanism 3 reduces, the energy given to the refrigerant in the sub compression mechanism 2 increases, so that the refrigerant with a higher temperature is supplied to the main compression mechanism 3. That is, even when heat transfer occurs from the main compression mechanism 3 to the sub compression mechanism 2, the decrease in the energy given by the main compression mechanism 3 substantially is cancelled out by the increase in the energy given by the sub compression mechanism 2. Therefore, the COP of the refrigeration cycle apparatus 1 does not decrease considerably.

In addition, the motor 8 is disposed between the main compression mechanism 3 and the sub compression mechanism 2. Thus, the power recovery mechanism 5 is placed further away from the main compression mechanism 3. As a result, the heat exchange between the main compression mechanism 3 and the power recovery mechanism 5 is inhibited more effectively.

Also in the present embodiment, the oil pump 72 is disposed at the lower end portion of the main compressor shaft 38. This configuration can place the main compression mechanism 3, which is at a relatively high temperature, away from the oil reservoir 16. As a result, a temperature increase of the oil reservoir 16 can be prevented. Accordingly, a temperature increase of the power recovery mechanism 5, which is disposed in the oil reservoir 16, can be inhibited. Thus, the COP of the refrigeration cycle apparatus 1 can be improved further.

The present embodiment has described an example in which the sub compression mechanism 2 and the power recovery mechanism 5 are fluid pressure motors. However, each of the sub compression mechanism 2 and the power recovery mechanism 5 may be one that performs a process for compressing or expanding the drawn refrigerant and thereafter discharges the refrigerant. That is, each of the sub compression mechanism 2 and the power recovery mechanism 5 may have a particular volumetric capacity ratio. That said, the fluid pressure motor has a simpler configuration than a compression mechanism that performs the compression process and an expansion mechanism that performs the expansion process. Therefore, when each of the sub compression mechanism 2 and the power recovery mechanism 5 is constructed by a fluid pressure motor, the configuration of the fluid machine 10A can be made simpler, and at the same time, a size reduction can be achieved. As a result, simplification, size reduction, and cost reduction of the refrigeration cycle apparatus 1 can be achieved. From the viewpoint of simplification, size reduction, and cost reduction, it is particularly preferable that each of the sub compression mechanism 2 and the power recovery mechanism 5 be a rotary-type fluid pressure motor.

By reducing the size of the power recovery unit 7 in this way, it is also possible to reduce the capacity of the oil reservoir 16. Thereby, the amount of the refrigeration oil held in the oil reservoir 16 can be reduced. As a result, the oil level in the oil reservoir 16 can be more stabilized. Thus, the refrigeration oil can be supplied to the main compression mechanism 3 and the power recovery unit 7 more reliably.

In addition, by constructing each of the sub compression mechanism 2 and the power recovery mechanism 5 by a fluid pressure motor, both the waveform of the recovery torque by the power recovery mechanism 5 and the waveform of the load torque of the sub compression mechanism 2 are made a substantially sine waveform with the rotation angle 360° of the power recovery shaft 12 being one period. As a result, the power recovery shaft 12 smoothly rotates without decelerating. Thereby, the efficiency in energy recovery can be improved. Moreover, vibrations and noises in the refrigeration cycle apparatus 1 can be suppressed.

Specifically, the time at which the first piston 21 of the power recovery mechanism 5 is located at the top dead center and the time at which the second piston 41 of the sub compression mechanism 2 is located at the top dead center are brought into synchronization with each other. Thereby, the waveform of load torque and the waveform of recovery torque can be matched to each other. In other words, the ratio of the load torque and the recovery torque is substantially constant at any rotation angle of the power recovery shaft 12. Therefore, an unevenness of the rotation speed of the shaft can be suppressed. As a result, the energy efficiency of the refrigeration cycle apparatus 1 can be improved further. Furthermore, since the unevenness of the rotation speed of the shaft can be suppressed, vibrations and noises in the refrigeration cycle apparatus 1 can be suppressed as well.

More specifically, in the present embodiment, the direction in which the first partitioning member 24 is disposed relative to the power recovery shaft 12 and the direction in which the second partitioning member 44 is disposed relative to the power recovery shaft 12 are made substantially the same. At the same time, the eccentric direction of the first piston 21 relative to the central axis of the first cylinder 22 and the eccentric direction of the second piston 41 relative to the central axis of the second cylinder 42 also are made substantially the same. Thereby, the time at which the first piston 21 of the power recovery mechanism 5 is located at the top dead center and the time at which the second piston 41 of the sub compression mechanism 2 is located at the top dead center are brought into synchronization with each other. This makes manufacturing of the fluid machine 10A easy.

In addition, a friction between the power recovery shaft 12 and the second and third closing members 13 and 14, which support the power recovery shaft 12 rotatably, can be reduced when the eccentric direction of the first piston 21 with respect to the central axis of the first cylinder 22 and the eccentric direction of the second piston 41 with respect to the central axis of the second cylinder 42 also are made substantially the same.

More specifically, a differential pressure force from the suction working chamber 23*a*, which is at a relatively high pressure, toward the discharge working chamber 23*b*, which is at a relatively low pressure, acts against the first piston 21 of the power recovery mechanism 5. Likewise, a differential pressure force from the discharge working chamber 43*b*, which is at a relatively high pressure, toward the suction working chamber 43*a*, which is at a relatively low pressure, acts against the second piston 41 of the sub compression mechanism 2. These differential pressure forces press the power recovery shaft 12 via the eccentric portions 12*b* and 12*c*, acting on the bearing portions of the second closing member 13 and the third closing member 14, which support the power recovery shaft 12 rotatably. As a consequence, a rotation inhibiting force arises against the power recovery shaft 12, promoting the abrasion of the power recovery shaft 12 and the abrasion of the bearing portions. In contrast, in the present embodiment, the directions of the differential pressure forces of the first piston 21 and the second piston 41 are opposite to each other. Therefore, the differential pressure forces are cancelled out between the first piston 21 and the second piston 41. As a result, the frictions between the power recovery shaft 12 and the second and third closing members 13 and 14 can be reduced. Accordingly, the motive power necessary to rotate the power recovery shaft 12 can be reduced, and the energy recovery can be enhanced. Furthermore, abrasions of the power recovery shaft 12 and the second and third closing members 13 and 14 can be suppressed also.

MODIFIED EXAMPLE 1

Figure 8:
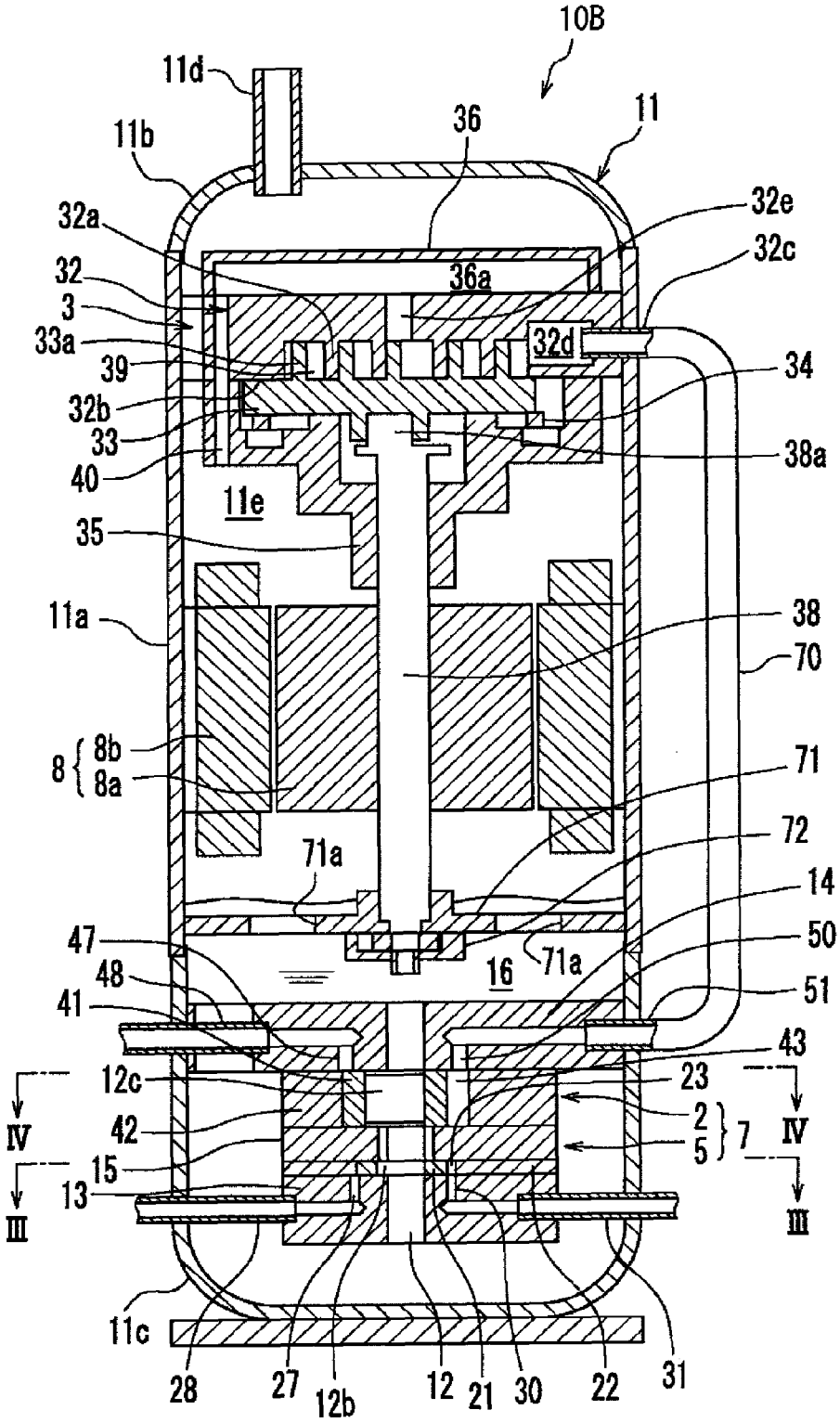
FIG. 8 is a cross-sectional view illustrating a fluid machine according to a modified example 1.

The foregoing embodiment has described an example in which the power recovery unit 7 is secured to the body shell 11*a*. It should be noted, however, that the present invention is not limited to this configuration. For example, as illustrated in FIG. 8, the bottom shell 11*c* may be formed in a relatively deep bowl shape, and the power recovery unit 7 may be attached to the bottom shell 11*c*. In this way, a fluid machine 10B can be assembled by attaching the bottom shell 11*c* to the body shell 11*a* after fitting the main compression mechanism 3 and the motor 8 to the body shell 11*a* as well as fitting the power recovery unit 7 to the bottom shell 11*c*. In other words, it is possible to separate an assemble line of the power recovery unit 7 from an assemble line of the main compression mechanism 3 and the motor 8. It also is possible to stock them.

Furthermore, in the configuration of the present modified example 1, the upper shell 11*b* and the body shell 11*a* to which the main compression mechanism 3 and the motor 8 are secured may be used in common with refrigeration cycle apparatuses with other configurations. The manufacturing costs of the upper shell 11*b* and the body shell 11*a* to which the main compression mechanism 3 and the motor 8 are secured can be reduced. In addition, design costs can be reduced. Furthermore, it becomes possible to reduce the stock of the components specifically designed for this refrigeration cycle apparatus 1.

MODIFIED EXAMPLE 2

The foregoing embodiment and modified example 1 have described examples in which the power recovery unit 7 is secured to the closed casing 11. It should be noted, however, that the present invention is not limited to this configuration. The power recovery unit 7 may be secured to other members than the closed casing 11. For example, as in a fluid machine 10C shown in FIG. 9, the power recovery unit 7 may be secured to the secondary bearing member 71 via a securing member 80. Alternatively, the power recovery unit 7 may be secured to the main compression mechanism 3. In that way, the need for a welding process and the like for the power recovery unit 7 and the closed casing 11 is eliminated, and the power recovery unit 7 can be secured easily at low cost.

In the present modified example 2, the main compressor shaft 38 of the main compression mechanism 3 and the power recovery shaft 12 of the power recovery unit 7 are provided separately from each other, as illustrated in FIG. 9. This makes it possible to dispose the main compressor shaft 38 and the power recovery shaft 12 in such a manner that the axial line of the main compressor shaft 38 and the axial line of the power recovery shaft 12 are not located on a linear line. Thereby, the degree of freedom in arrangement of the main compression mechanism 3 and the power recovery unit 7 and the degree of freedom in designing the fluid machine 10C are improved.

MODIFIED EXAMPLE 3

Figure 10:
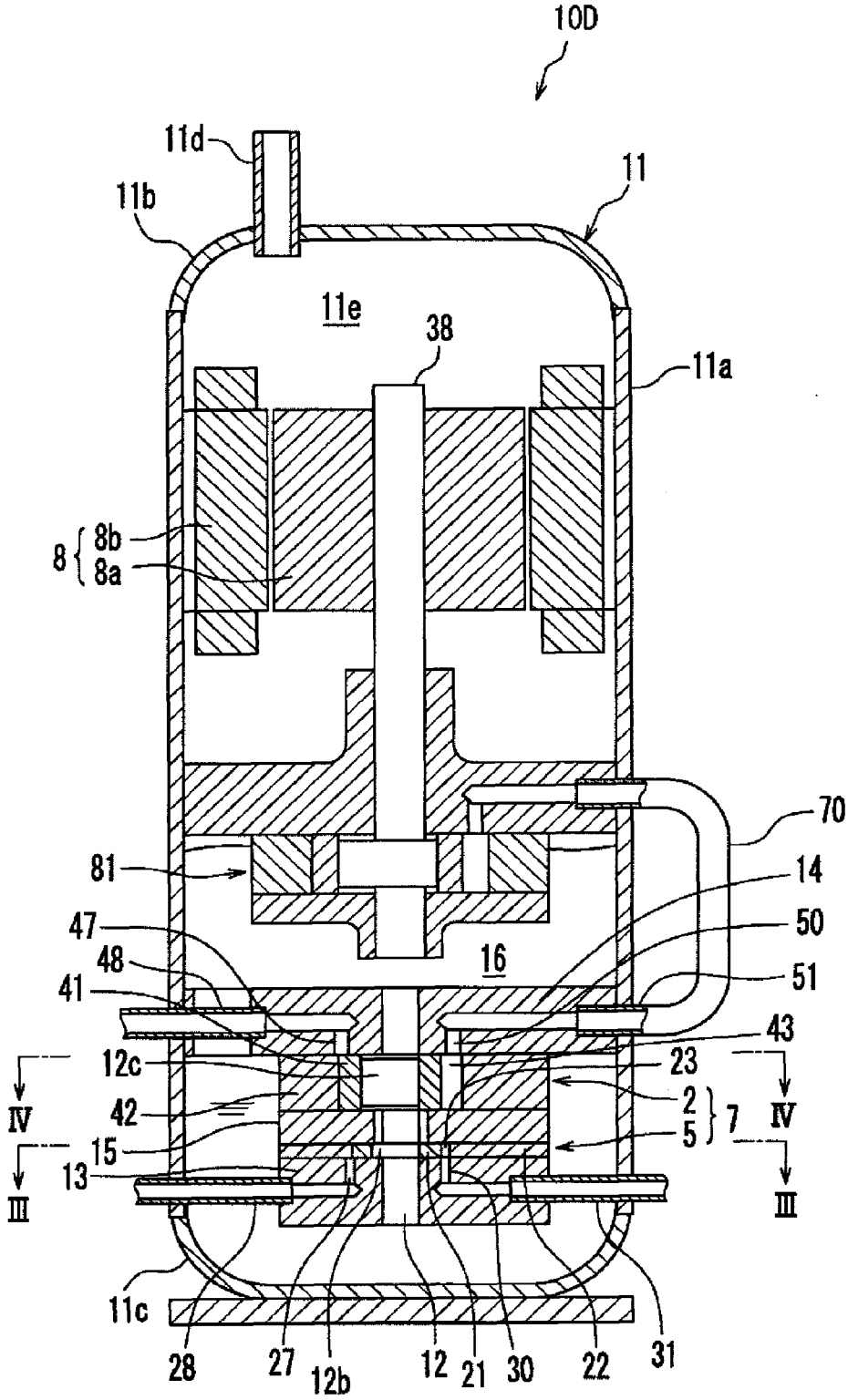
FIG. 10 is a cross-sectional view illustrating a fluid machine according to a modified example 3.

The foregoing embodiment and modified examples 1 and 2 have described examples in which the refrigeration oil is supplied to the main compression mechanism 3 using the oil pump 72 as an oil supply unit. It should be noted, however, that the invention is not limited to this configuration. For example, as in a fluid machine 10D shown in FIG. 10, the refrigeration oil may be supplied to a main compression mechanism 81 by disposing the main compression mechanism 81 closer to the oil reservoir 16 than the motor 8 without providing the oil pump 72 and immersing the main compression mechanism 81 directly in the oil reservoir 16. When the main compression mechanism 81 is immersed directly in the oil reservoir 16, it is preferable that the main compression mechanism 81 be a rotary type compression mechanism.

OTHER MODIFIED EXAMPLES

From the viewpoint of compactness of the fluid machines 10A to 10D, all of the suction passage 27, the discharge passage 30, the suction passage 47, and the discharge passage 50 may be formed in the first closing member 15.

The refrigerant circuit 9 may be charged with refrigerant that does not reach a supercritical pressure in the high pressure side. Specifically, the refrigerant circuit 9 may be charged with a fluorocarbon-based refrigerant.

An example in which the refrigerant circuit 9 is constituted by the main compression mechanism 3, the radiator 4, the power recovery mechanism 5, the evaporator 6, and the sub compression mechanism 2 has been described, but the refrigerant circuit 9 may have other components than the just-mentioned components.

The foregoing embodiment and modified examples have described examples in which both the power recovery mechanism 5 and the sub compression mechanism 2 are constituted by a fluid pressure motor. It should be noted, however, that the present invention is not limited to this configuration. For example, the power recovery mechanism 5 may be constructed by an expansion mechanism. The sub compression mechanism 2 may be constructed by a compression mechanism in which the refrigerant is compressed in a working chamber.

<<Definitions of the Words and the Like in the Present Specification>>

In the present description, "refrigeration oil" includes not only mineral oil but also synthetic oil.

"Fluid pressure motor" refers to the one that performs a suction process for drawing refrigerant and a discharge process for discharging the refrigerant substantially continuously. Specifically, in the fluid pressure motor, there is substantially no period in which the suction passage and the discharge passage for the refrigerant are closed at the same time. In other words, in the fluid pressure motor, at least one of the suction passage and the discharge passage for the refrigerant is opened substantially over the entire period. Herein, the phrase "there is substantially no period in which the suction passage and the discharge passage for the refrigerant are closed at the same time" is meant to include the concept that the suction passage and the discharge passage are closed instantaneously at the same time to a degree such that torque fluctuations do not occur.

The term "expansion mechanism" refers to a mechanism that performs a suction process for drawing refrigerant, an expansion process for expanding the drawn refrigerant, and a discharge process for discharging the expanded refrigerant That is, the "expansion mechanism" is a mechanism that isolates the working chamber temporarily after the completion of the suction process, expands the refrigerant in the isolated working chamber, and thereafter discharges the refrigerant from the working chamber.

The term "compression mechanism" refers to a mechanism that performs a suction process for drawing refrigerant, a compression process for compressing the drawn refrigerant, and a discharge process for discharging the expanded refrigerant. That is, the "compression mechanism" is a mechanism that isolates the working chamber temporarily after the completion of the suction process, compresses the refrigerant in the isolated working chamber, and thereafter discharges the refrigerant from the working chamber.

INDUSTRIAL APPLICABILITY

A refrigeration cycle apparatus furnished with a fluid machine according to the present invention may be applied to water heaters, air conditioners, room heating apparatuses, and the like.

The invention claimed is:

1. A fluid machine comprising:

a closed casing in which an oil reservoir is formed in a bottom part;

a main compression mechanism, disposed in the closed casing for compressing a working fluid, and to which oil held in the oil reservoir is supplied;

a rotary electric motor disposed above the oil reservoir in the closed casing;

a main compressor shaft for coupling the main compression mechanism and the rotary electric motor to each other so that the main compression mechanism is driven by the rotary electric motor;

a power recovery mechanism, disposed in the oil reservoir, for recovering motive power from the working fluid by performing a suction process for drawing the working fluid and a discharge process for discharging the drawn working fluid;

a sub compression mechanism, disposed in the oil reservoir and driven by the power recovery mechanism, for compressing the working fluid and discharging the working fluid to the main compression mechanism side; and a power recovery shaft for coupling the power recovery mechanism and the sub compression mechanism to each other so that the sub compression mechanism is driven by motive power recovered by the power recovery mechanism.

2. The fluid machine according to claim 1, wherein the power recovery mechanism is disposed below the sub compression mechanism.

3. The fluid machine according to claim 1, further comprising an oil supply unit, disposed at a lower end portion of the main compressor shaft, for supplying the oil to the main compression mechanism.

4. The fluid machine according to claim 1, wherein the main compression mechanism discharges the compressed working fluid into the closed casing.

5. The fluid machine according to claim 1, wherein the rotary electric motor is disposed at a location lower than the main compression mechanism.

6. The fluid machine according to claim 1, wherein:

the sub compression mechanism compresses the working fluid by performing a suction process for drawing the working fluid and a discharge process for discharging the drawn working fluid; and at least one of the power recovery mechanism and the sub compression mechanism is a fluid pressure motor performing the suction process and the discharge process in a substantially continuous manner.

7. The fluid machine according to claim 1, wherein at least one of the main compression mechanism and the power recovery mechanism is a rotary type mechanism.

8. The fluid machine according to claim 1, further comprising:

a connecting pipe for connecting a discharge side of the sub compression mechanism and a suction side of the main compression mechanism, wherein at least a portion of the connecting pipe is disposed outside the closed casing.

9. The fluid machine according to claim 1, wherein:

the power recovery mechanism and the sub compression mechanism constitute a power recovery unit; and the power recovery unit is secured to the closed casing.

10. The fluid machine according to claim 9, wherein:

the closed casing includes:

a tubular body shell;

an upper shell for closing an upper opening of the body shell; and a bottom shell for closing a lower opening of the body shell, and the power recovery unit is secured to the body shell or the bottom shell.

11. The fluid machine according to claim 9, wherein the power recovery unit is secured to the closed casing with the sub compression mechanism.

12. The fluid machine according to claim 1, wherein:

the power recovery mechanism and the sub compression mechanism constitute a power recovery unit; and the power recovery unit is secured to a member other than the closed casing.

13. A refrigeration cycle apparatus comprising a fluid machine according to claim 1.

14. The refrigeration cycle apparatus according to claim 13, wherein the working fluid is carbon dioxide.

* * * * *